US005156553A

United States Patent [19]

Katsumata et al.

[11] Patent Number: 5,156,553

[45] Date of Patent: Oct. 20, 1992

[54] CONNECTOR ASSEMBLY FOR FILM CIRCUITRY

[75] Inventors: Akira Katsumata; Hiroshi Arisaka, both of Tama, Japan

[73] Assignee: Kel Corporation, Tokyo, Japan

[21] Appl. No.: 689,348

[22] Filed: Apr. 22, 1991

[30] Foreign Application Priority Data

| | | | |
|---|---|---|---|
| May 29, 1990 | [JP] | Japan | 2-56044 |
| May 30, 1990 | [JP] | Japan | 2-140217 |
| Jul. 26, 1990 | [JP] | Japan | 2-198768 |
| Dec. 3, 1990 | [JP] | Japan | 2-40402 |
| Jan. 17, 1991 | [JP] | Japan | 3-18242 |

[51] Int. Cl.[5] ..... H01R 9/09

[52] U.S. Cl. ..... 439/62; 439/67; 439/79; 439/260; 439/493

[58] Field of Search ..... 439/62, 65, 67, 74, 439/77, 329, 259, 260, 492, 493, 79, 80

[56] References Cited

U.S. PATENT DOCUMENTS

| | | | |
|---|---|---|---|
| Re. 31,477 | 12/1983 | Marshall | 174/117 FF |
| 3,923,364 | 12/1975 | Shapiro et al. | 439/493 |
| 4,296,457 | 10/1981 | Hahlganss | 174/117 FF |
| 4,560,221 | 12/1985 | Olsson | 439/260 |
| 4,658,331 | 4/1987 | Berg | 439/66 |
| 5,041,003 | 8/1991 | Smith et al. | 439/259 |

FOREIGN PATENT DOCUMENTS 40-2588 2/1965 Japan .

*Primary Examiner*—Neil Abrams

*Attorney, Agent, or Firm*—Robert W. J. Usher

[57] ABSTRACT

A film circuit connector assembly comprises matable housing assemblies each including an outer insulating housing receiving a film circuit supporting member carrying a film circuit with a mating contact area therein extending away from a mating face along a film circuit supporting wall with a circuit board engaging area of the film circuit extending out from a base of the housing assembly. A cylindrical spring is mounted in a recess extending along at least one film supporting wall in engagement with a rear face of a contact area pressing the contact areas of the mating connectors together. In one example, the housing assembly clamps free ends of the film circuit conductors in resiliently deformed condition into engagement with the circuit board. Apertures may be formed through the insulating web of the circuit board engaging area exposing conductive tracks thereof at locations corresponding to respective reflow solder pads of a circuit board and forming pockets receiving and confining the reflowing solder therein to avoid solder bridges being formed between adjacent tracks.

53 Claims, 40 Drawing Sheets

Fig 8a
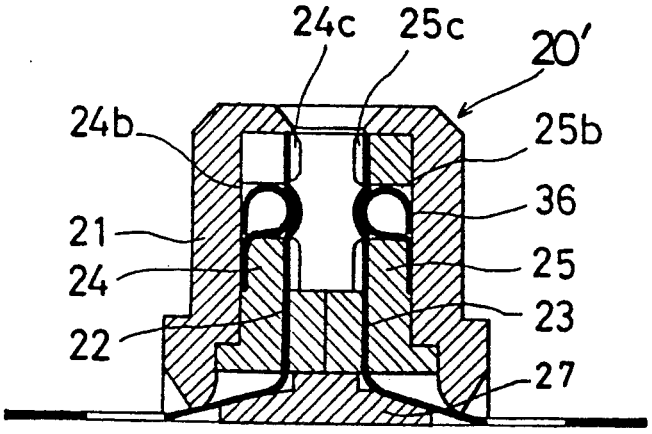
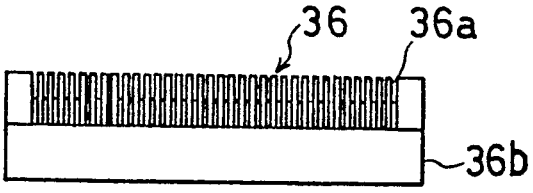
Fig 8b
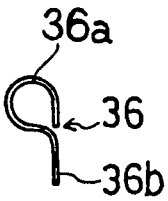
Fig 8c

Fig 15a
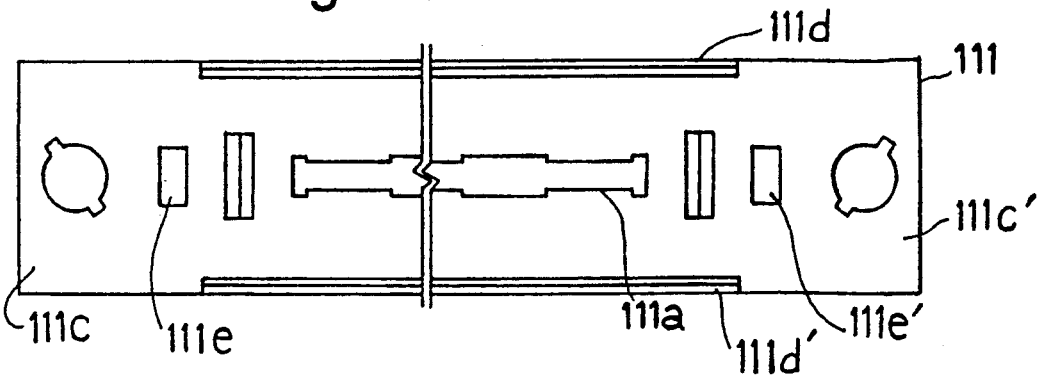
Fig 15b
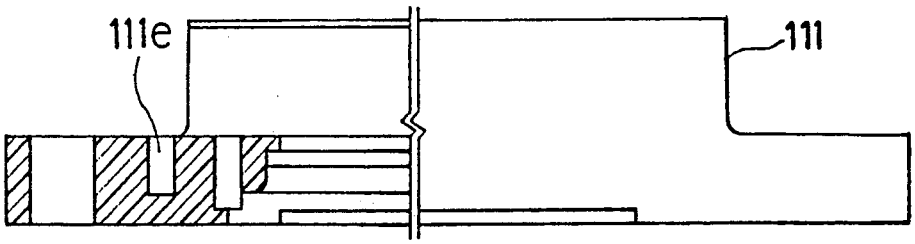
Fig 15c
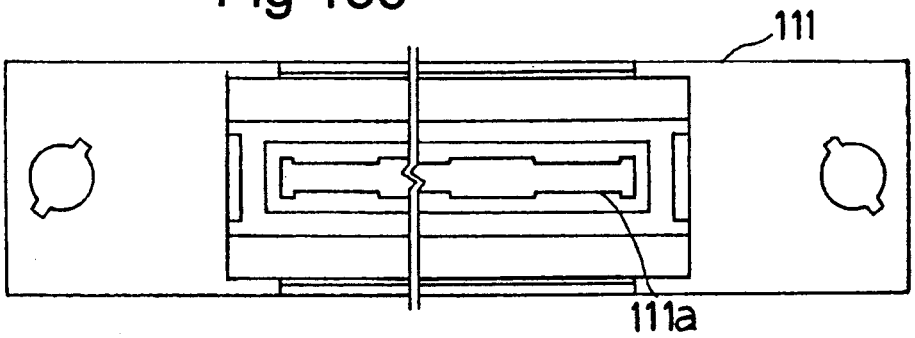
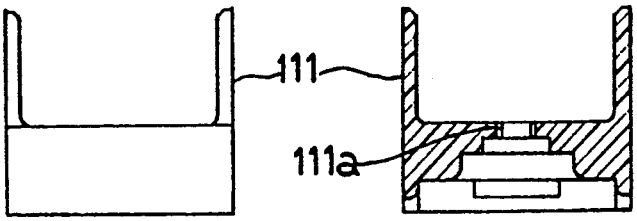
Fig 15d Fig 15e

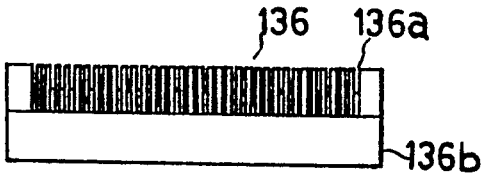
Fig 18a
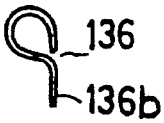
Fig 18b
Fig. 19
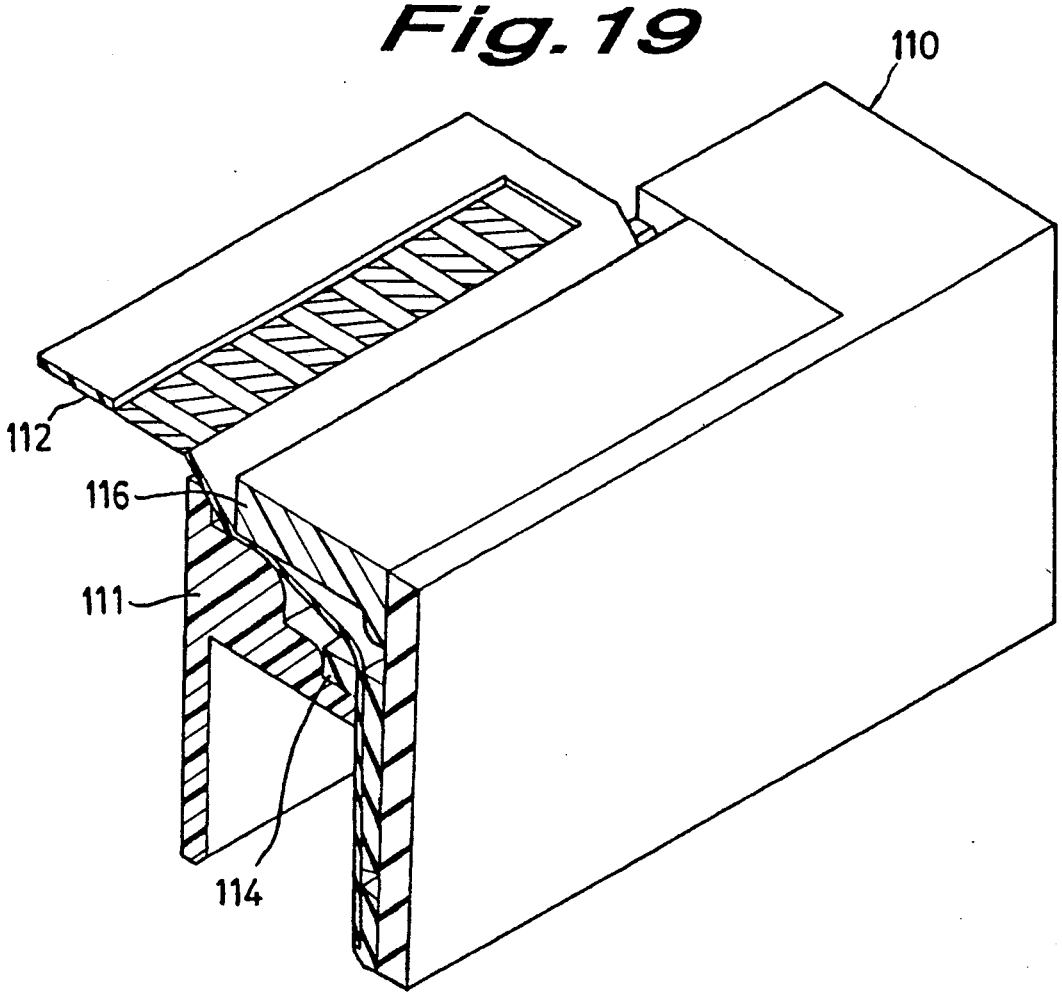

Fig. 23
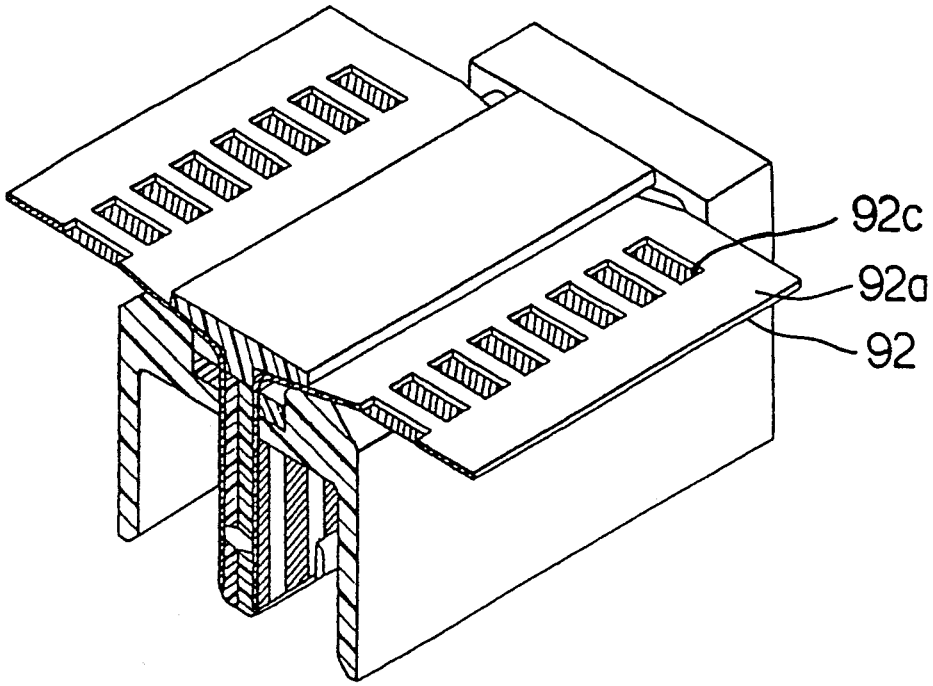
Fig 24a
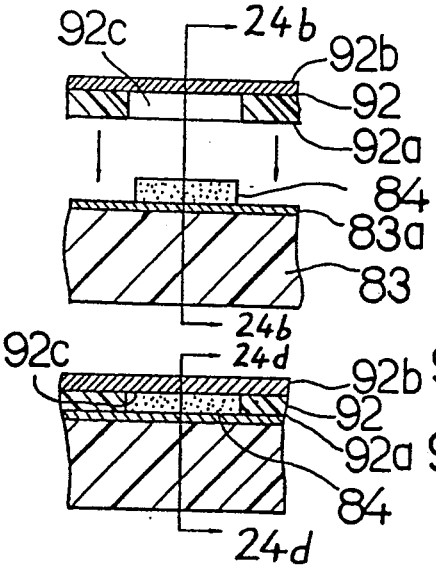
Fig 24b
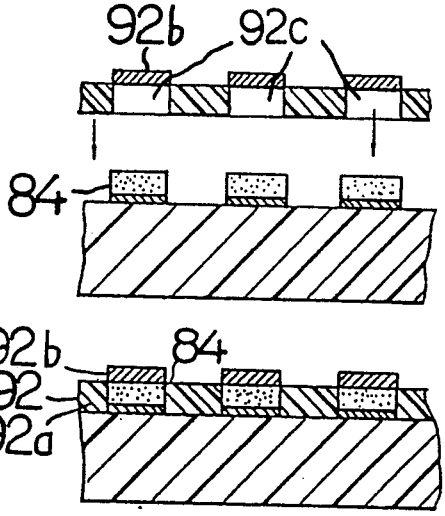
Fig 24c
Fig 24d

*Prior Art*
Fig 24e
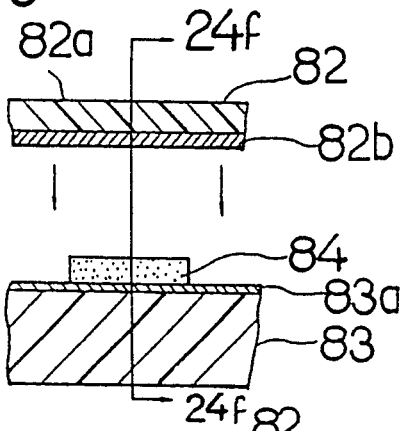
Fig 24f
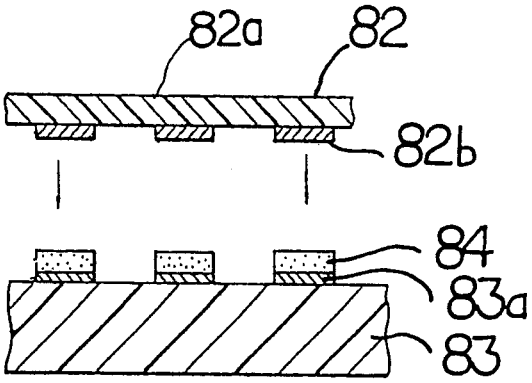
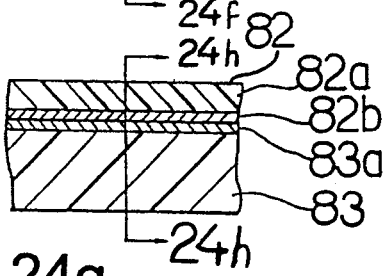
Fig 24g
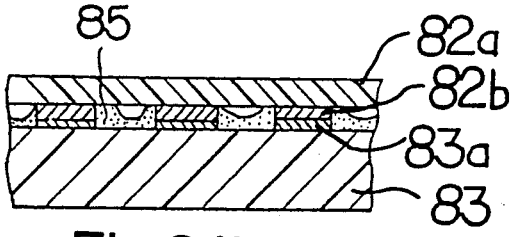
Fig 24h Fig.25
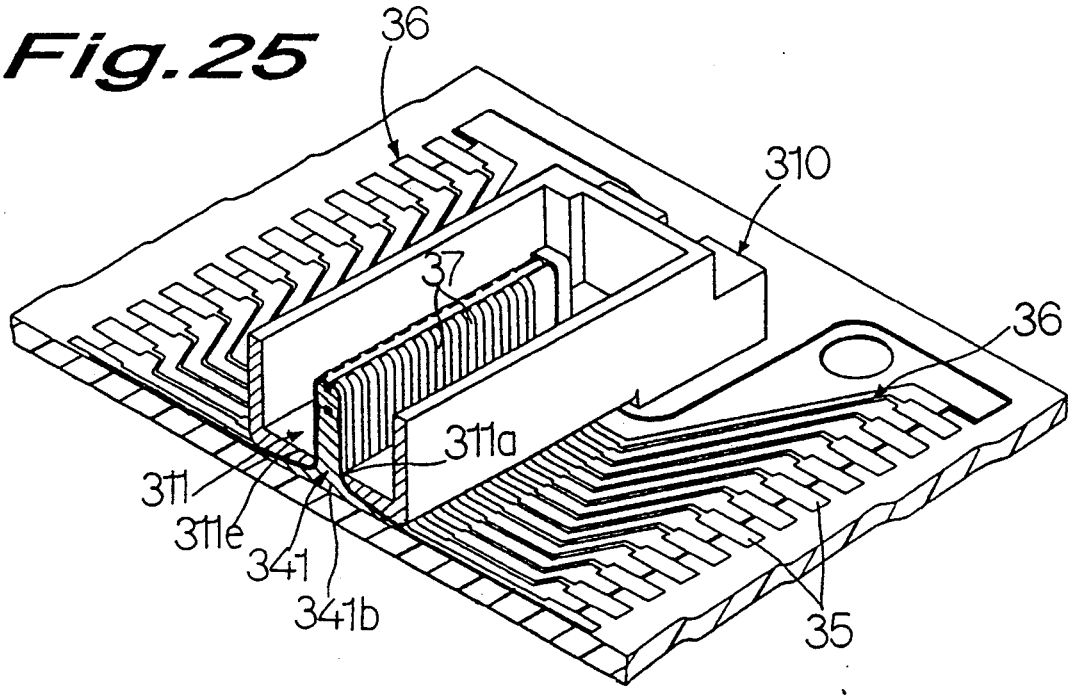
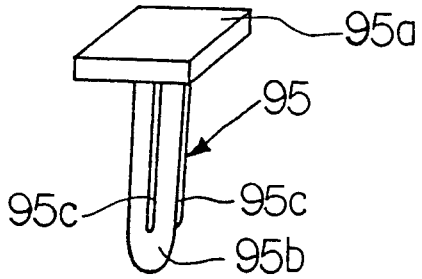
Fig 26a
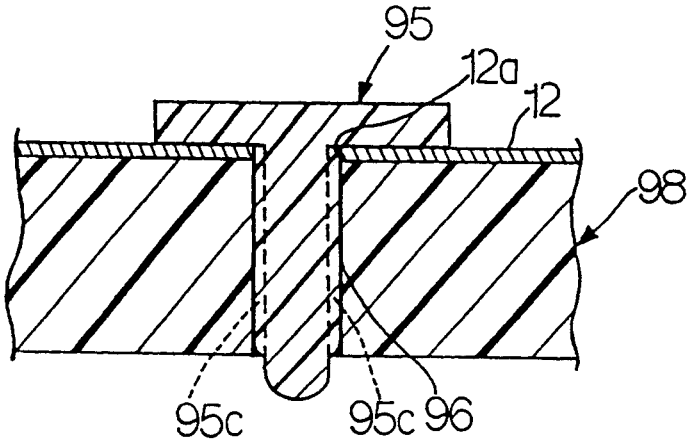
Fig 26b

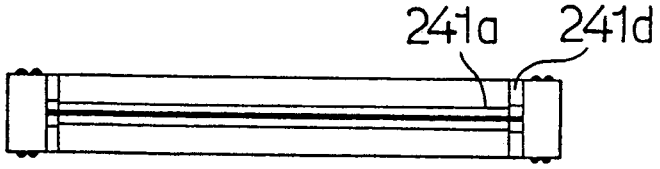
Fig 31a
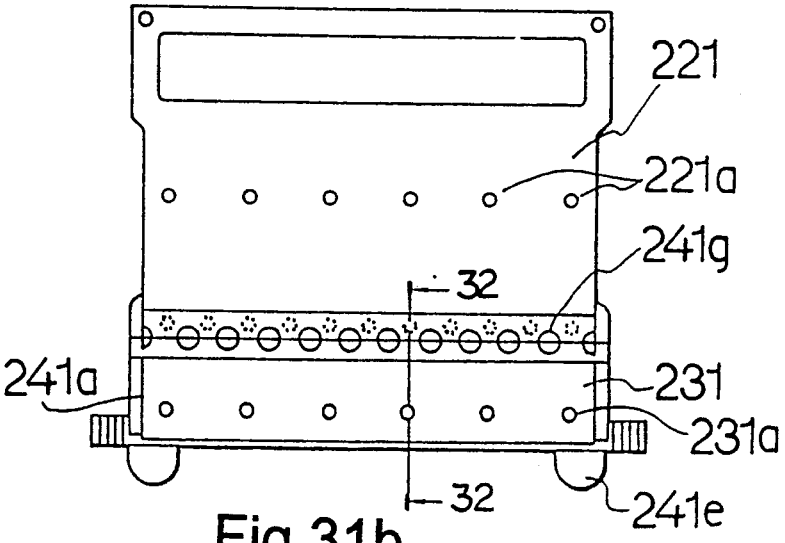
Fig 31b
Fig. 32
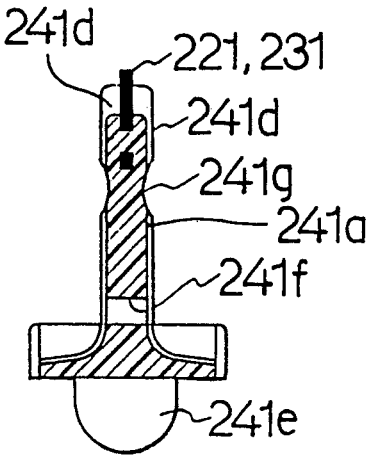

CONNECTOR ASSEMBLY FOR FILM CIRCUITRY

FIELD OF THE INVENTION

The invention relates to film circuit connectors and to film circuitry, particularly for connection to circuit boards.

BACKGROUND OF THE INVENTION

The increasing miniaturization of electrical devices together with the often conflicting requirements for high volume, mass production at low manufacturing and applied cost but with zero defect, place exacting demands on connectors and associated circuitry.

In electrical connectors having loose-piece stamped and formed metal contacts assembled in plastic housings, the individual contacts must each be securely located by insulating wall portions on the housings. However, a change in contact size or pitches usually necessitates a different configuration of insulating wall portions requiring construction of different molds even when the outside configuration of the housing remains the same. A range or family of connectors with different contact pitches is therefore expensive to manufacture.

In one known connector shown in FIGS. 21 and 22, a male and female housing 50 and 51, respectively, comprise a longitudinally moveable male contact 52 of stiff, or hard material, such as a metalized fiberglass circuit board, advanceable through a housing mouth 54, and a pair of film circuits 53 arranged in face-to-face relation in alignment with a housing mouth 55. The film circuits have leading ends 57 secured around a cylindrical body of metal loaded elastomer 58 located in a housing compartment adjacent the mating face. The rigid male contact body with hard contacts is advanced through the mouths 54 and 55 and enters between the film circuits urging them apart with the resultant resilient deformation of the elastomer 58 effecting a contact force between the individual circuit plates on the film circuits and the board.

Disadvantages arise, however, from the non-flexible nature of the board permitting, only vertical or horizontal installation of the connectors they cannot be stacked, while exposed glass fibers and rough sheared corners of the metal contacts can scarify the film circuit surfaces, particularly during mating and unmating movement thereby limiting the number of reconnections that are possible.

Furthermore, variations in thickness of the board arising from poor manufacturing tolerances and warpage, cause variations in contact pressure increasing the risk of a poor or unreliable electrical connection.

In another known connector disclosed in Japanese Patent Publication 40-2588, reliance for contact pressure between engaging film circuits is placed on free end portions of walls of a channel section spring within which the film circuit extends in slack condition. However, for reliable contact pressure, the channel walls should be relatively long, precluding a connector structure of low height, while the slack condition increases risk of contact misalignment, particularly with tracks at desirably small pitch.

The invention concerns film circuit connectors which avoid or ameliorate at least some of the above-noted disadvantages.

According to one aspect of the invention, matable connector members each locate a film circuit extending in taut condition away from a mating face with one film circuit having a contact area extending across an elongate spring mounted parallel to the mating face, resilient depression of which spring urges contact areas of the respective film circuits together into electrical connection.

Preferably, the connector members are matable to bring the contact areas into face-to-face alignment with zero insertion force and an actuating element is provided on one connector for movement of the spring, providing the contact pressure.

The invention also provides a connector comprising an outer housing opening to opposite, mating and circuit board engaging faces, and a film circuit supporting member on which a film circuit is anchored, insertable through the board engaging face into the outer housing to locate the film circuit securely therein extending away from the mating face with a board connecting portion of the film circuit exiting from the board engaging face.

This arrangement affords easy assembly of the film circuit in the housing.

The invention further provides a film circuit connector in which conductive tracks on contact areas of the film circuit within a connector housing are of preselected, different widths and/or pitches (separation) according to desired electrical characteristics.

The invention also provides a film circuit connector in which conductive tracks on contact areas of the film circuit within the connector housing are of less width and pitch than corresponding portions of such conductive tracks on circuit board engaging areas of the film circuit outside the connector housing, facilitating alignment for connection to respective individual conductive tracks of the circuit board.

According to a further aspect of the invention, an electrical connector includes a matable insulating housing assembly, a film circuit supported thereby having a contact area therein for electrical connection with a contact body of a mating connector and, an external circuit board engaging portion, areas of the film circuit adjacent the board engaging portions being clamped by the housing to exit therefrom inclined towards the circuit board so that the board engaging portions will be resiliently flexed against the circuit board when the connector is mounted thereon.

Preferably, free end portions of film circuit conductors or tracks are stripped of the insulating web to provide the resiliently flexed board engaging portions enabling direct connection to respective conductive pads of the circuit board when the connector is mounted thereon.

Another problem arising when connecting conductive tracks of, a film circuit to a circuit board using a reflow solder technique is that, on reflow, solder can be squeezed from the location of the solder pads across the board by pressure applied during reflow to the engaging surfaces to be connected, causing short circuiting solder bridges between adjacent conductive tracks.

According to an additional, separate, aspect of the invention a board engaging portion of a film circuit has apertures formed through the insulating web thereof exposing lower surfaces of discrete portions of conductive tracks to the web face thereby providing pockets for receiving and confining the reflow solder pads therein during reflow.

Thus, both the risk of solder bridges is avoided and the accurate and stable location of the film circuit on the circuit board assisted by receipt of the individual solder pads respective pockets, affording low applied cost.

The invention includes the apertured film circuit per se and the technique of connection thereto using the reflow process.

BRIEF DESCRIPTION OF THE DRAWINGS

Specific embodiments of the invention will now be described by way of example only with reference to the accompanying drawings in which:

FIG. 8*a, b* and *c* are, respectively, cross-sectional, plan and side elevational views of a modified receptacle connector and a spring providing the principal modification;

FIG. 18*a* and *b* are plan and end elevational views of an alternative spring structure;

FIG. 19 is a perspective view partly in cross-section of a modification of the connector of FIG. 11;

FIG. 23 is a perspective view, partly in cross-section of another example of connector with circuit board engaging portions of the film circuits formed with reflow solder pad confining apertures;

FIG. 24*a* and *b* are cross-sectional views in orthogonal places of the apertured film circuit shown in FIG. 23 aligned for connection to a circuit board by a reflow solder technique; c and d are, respectively, similar views after connection to the film circuit board; e and f are, respectively, similar views of a conventional film circuit; and, g and h are respectively, similar views of the prior film circuit after connection to the circuit board;

FIG. 25 is a perspective view partly in cross-section of a further example of plug connector in which circuit board engaging portions or tracks of the film circuit extending circuit outside the connector are of increased width and pitch mounted on a circuit board;

FIG. 26*a* is a perspective view of a film circuit fastener according to the invention;

FIG. 26*b* is a cross-sectional view of the fastener of FIG. 26*a* received in an aperture in a circuit board fastening a film circuit thereto;

FIG. 31*a* and *b* are plan and side elevational views of a film circuit supporting member of the connector of FIG. 27 with one film circuit member raised;

FIG. 32 is a cross-sectional view of the film circuit supporting member of the connector of FIG. 27;

DESCRIPTION OF PREFERRED EMBODIMENTS

Figure 1:
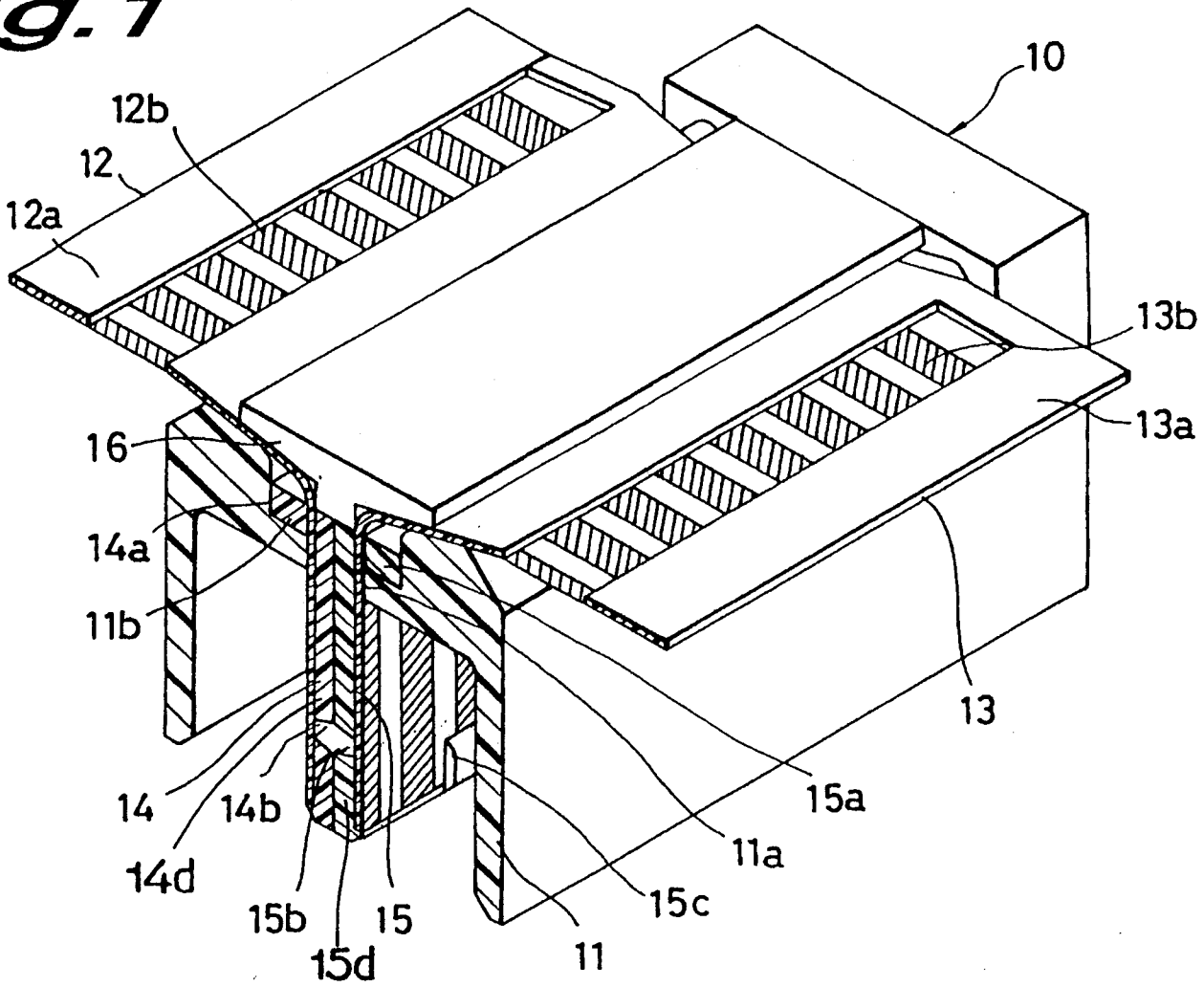
FIG. 1 is a perspective view, partly in cross-section of a first example of plug connector.
Figure 2:
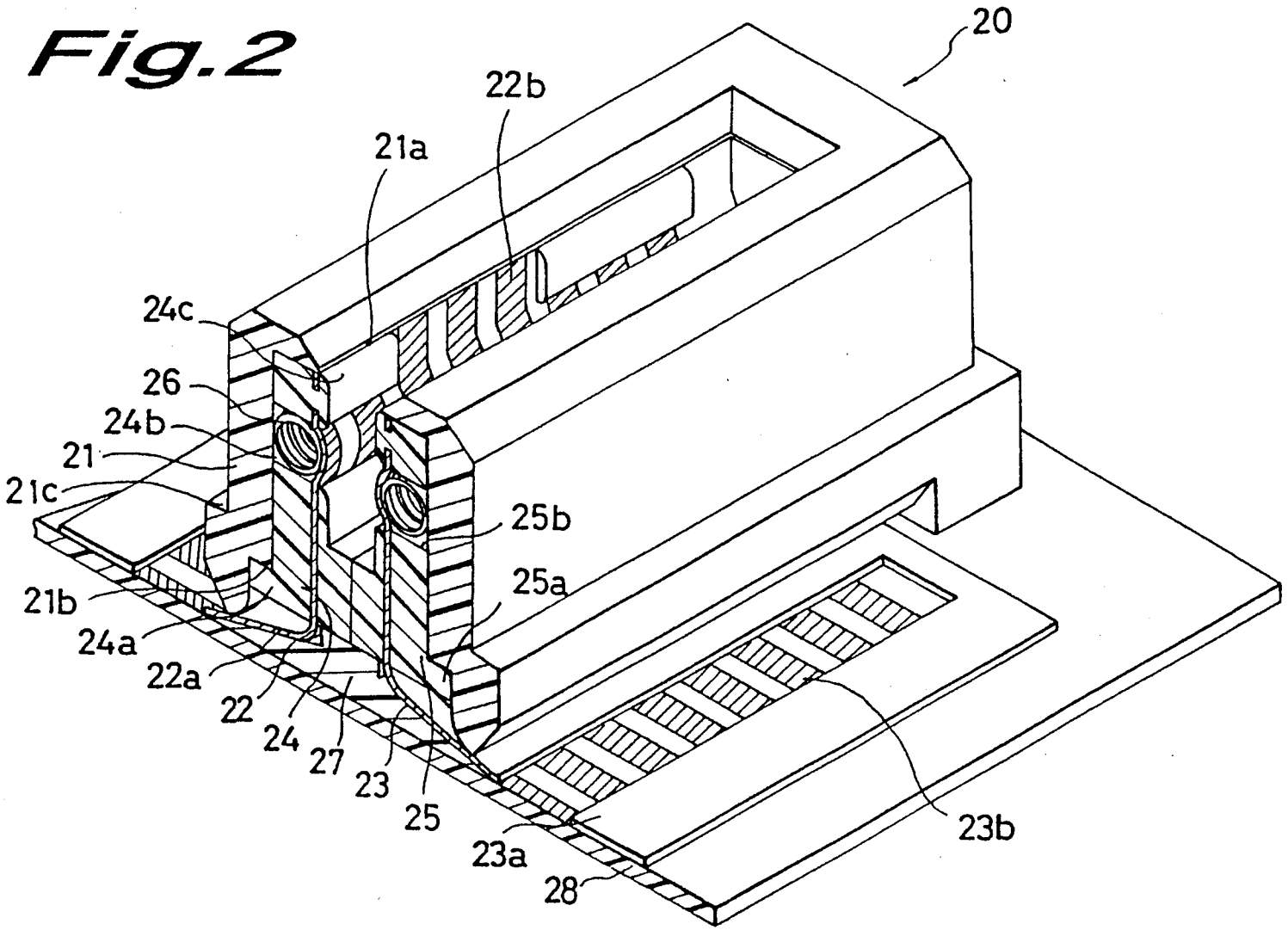
FIG. 2 is a perspective view, partly in cross-section of a first example of receptacle connector on a backing plate.
Figure 3D:
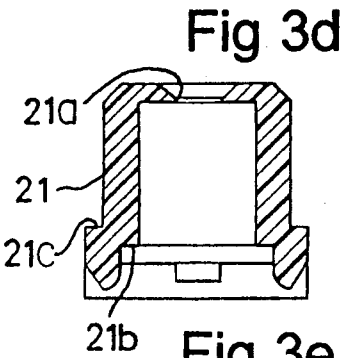
FIG. 3*a, b, c, d,* are *e* are, respectively, plan, side elevational, underplan, cross-sectional and end elevational views of a housing of the receptacle connector of FIG. 2.
Figure 3E:
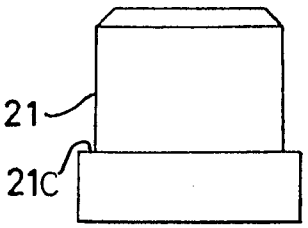
Figure 3A:
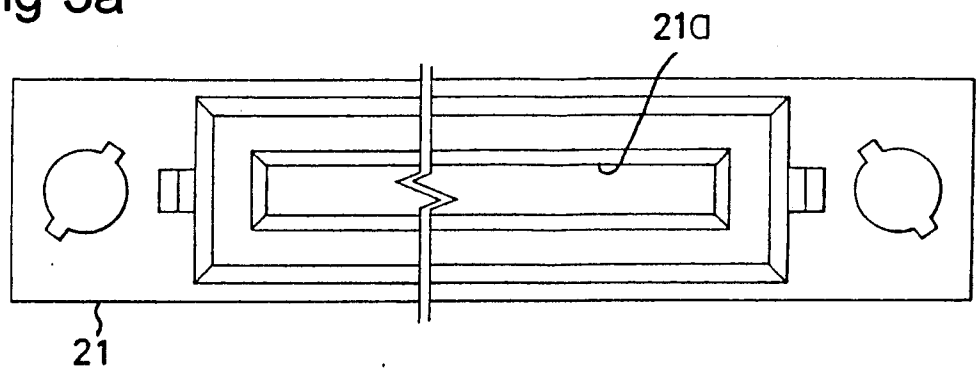
Figure 3B:
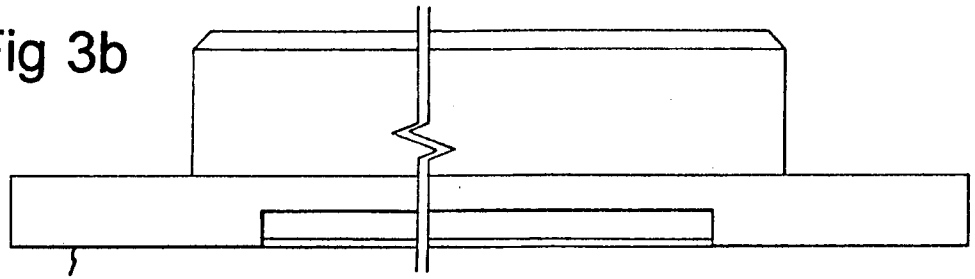
Figure 3C:
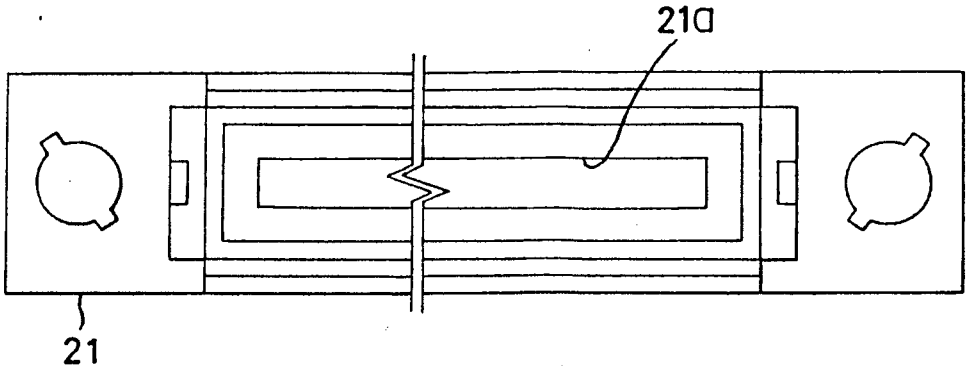
Figure 5A:
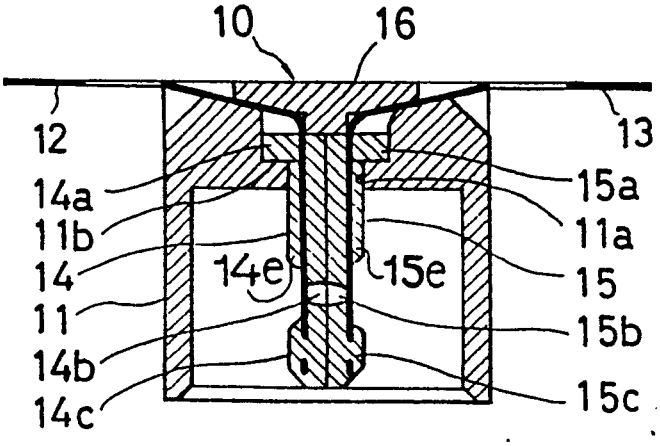
FIG. 5*a, b,* and *c* are, respectively, cross-sectional views of the plug connector, receptacle connector, and side elevational view of a coil spring of the receptacle connector.
Figure 5B:
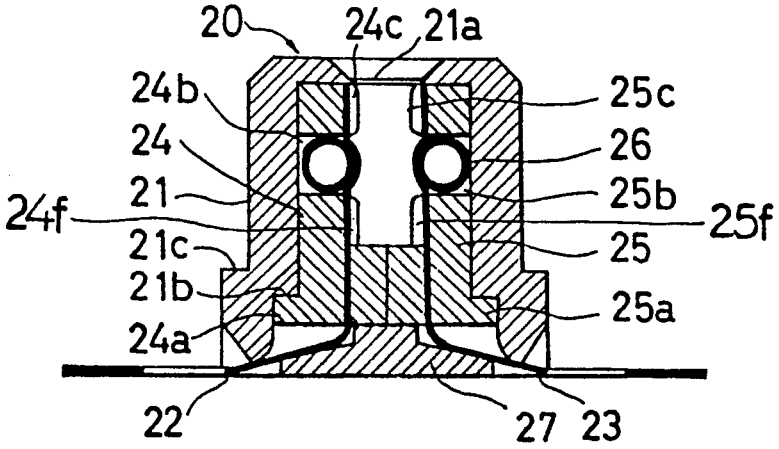
Figure 6:
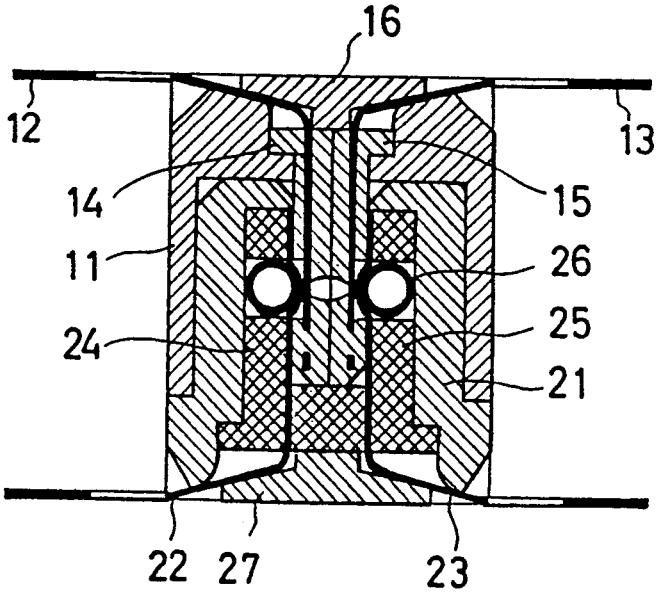
FIG. 6 is a cross-sectional view of the plug and receptacle connectors in mated condition.
Figure 7A:
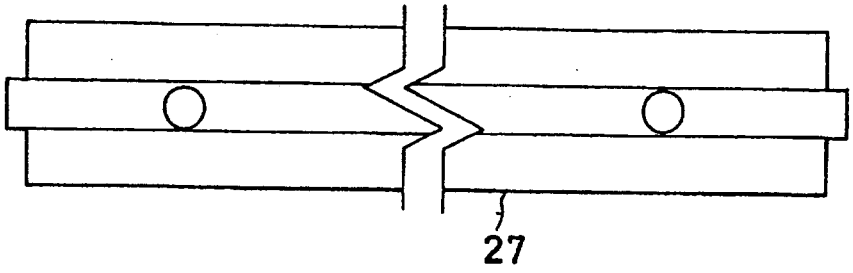
FIG. 7*a* and *b* are, respectively, plan and end elevational views of a base member of the receptacle connector of FIG. 2.
Figure 7B:
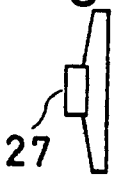

As shown particularly in FIGS. 1, 5*a* and 6, the plug connector 10 comprises a housing 11 molded in one piece of insulating plastic material, first and second film circuit or sheet-form circuits 12 and 13, respectively, of L-shaped cross-section, first and second film circuit supporting and locating members 14 and 15, respectively and, a base member 16 of generally T-shaped cross-section.

The housing 11 is channel section having opposed longitudinally extending side walls and end walls upstanding from a base wall through the center of which an elongate aperture 11*a* extends in communication with a longitudinally extending recess 11*b* which opens out, via divergent, longitudinally extending shoulders to a lower face of the housing.

The film circuit supporting members 14 and 15 are substantially identical L-section, one-piece, plastic moldings having, respectively, locating flanges or feet 14*a* and 15*a* for receipt in the recess 11*b*, film circuit supporting walls 14*d* and 15*d*, respectively, extending upwardly therefrom and having portions of increased thickness 14*e* and 15*e* at spaced apart locations forming aligned castellations in which portions the film circuits are in-molded, the film circuits 12 and 13 extending upwardly along the respective front faces thereof providing an exposed horizontal strip. Elongate slots or apertures 14*b* and 15*b* extend through the respective walls behind the exposed film circuit strip terminating at locations spaced from each longitudinal end of the respective film circuit supporting members. Further, longitudinally spaced portions of increased thickness 14*c* and 15*c* in vertical alignment with portions 14*e* and 15*e* respectively form castellated heads at the mating, upper ends of the walls similar to the example of FIG. 15*f–i*, in which portions apertured free upper ends of the respective film circuits are in molded thereby retaining the film circuits located on the front face of the film circuit supporting members.

The film circuits 12 and 13 can be formed from discrete circuit tracks or paths 12*b* of conductive foil applied to a flexible insulating web 12*a* by the well known FPC or TAB (tape automated bonding) techniques or FEC (flexible etched circuitry) or even printed using conductive ink.

Figure 4A:
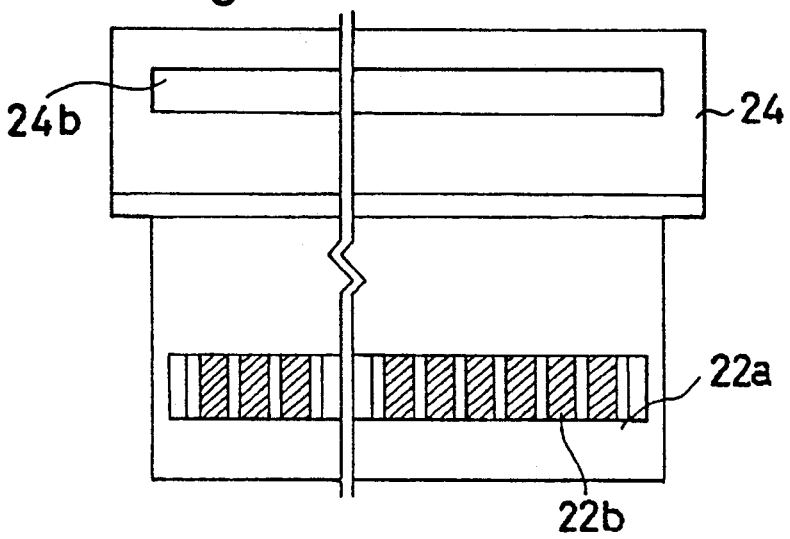
FIG. 4*a, b, c* and *d* are, respectively outer elevational, end elevational, inner elevational and cross-sectional views of a film circuit supporting member of the receptacle connector of FIG. 2.
Figure 4B:
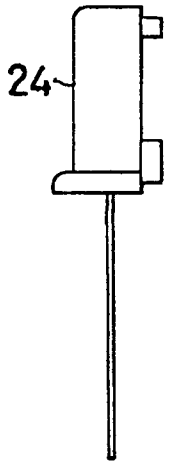
Figure 4C:
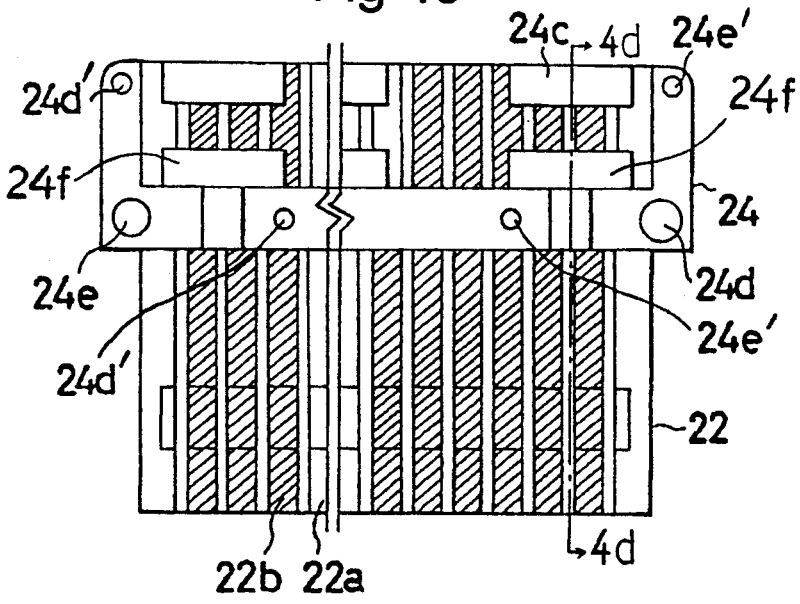
Figure 4D:
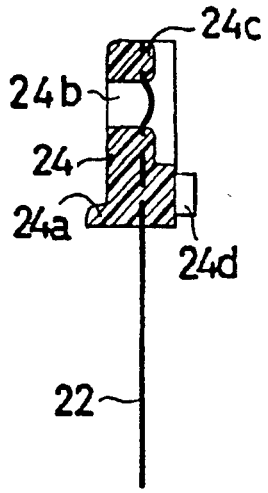

The film circuits 12 and 13 are insert molded or in molded with the film circuit supporting members 14 and 15, respectively, to extend from the castellated heads down the front face of the wall portions and through the feet. Rear faces of the two film circuit supporting members are then butted together in back-to-back relation with locating engagement of complementary pins and recesses formed on such faces (similar to those shown for example in FIGS. 15 and 4*c*) and with the apertures in communication to form a T-shaped sub-assembly or main contact body.

The plug connector is assembled by inserting the sub-assembly so formed, heads leading, through the aperture 11*a* in the base wall of the housing until the flanges 14*a* and 15*a* seat in upper corners of the recess 11*a*. The base member 16 is then inserted into the recess 11*a* and affixed to the housing, for example, by adhesive or spot welding to opposite end walls thereof, with the respective film circuits extending from the feet 14*a* and 15*b*, respectively, through the recess 11*a*, the transverse bases of the film circuits being gripped between the downwardly and outwardly diverging shoulders on opposite sides of the recess 11*b* and the upper shoulder facing surfaces of the base member 16.

As shown in FIGS. 1, 3, 4, 5*b*, 6 and 7, the receptacle 20 comprises a housing 21 molded in one piece of insulating plastic material as a tube of generally rectangular cross-section, film circuits 22 and 23, film circuit supporting members 24 and 25, respectively, a pair of identical helical coil springs 26, and an elongate T-section base member 27.

As shown particularly in FIG. 3(*a*)–(*e*), inner and outer walls of the housing are stepped at locations adjacent the base to provide, respectively, downwardly and upwardly facing peripherally extending, inner and outer, shoulders 21*b* and 21*c*, respectively. A mouth 21*c* of restricted size is formed at the top of the housing where it is restricted in size by a lip 21*c*.

As shown particularly in FIG. 4(*a*)–(*d*), the film circuit supporting members 24 and 25 are substantially identical and are each molded in one piece of plastic material as generally rectangular blocks. The member 24 comprises a base or foot providing a rearwardly extending locating flange 24*a* engageable with the step 21*b*, and, towards a top, a longitudinally extending spring receiving through-slot 24*b*. Film circuit supporting wall portions 24*c* of increased thickness provide a top castellated in complementary arrangement to the film circuit supporting members 14 and 15, in which portions 24*c* the apertured upper edges of the film circuits 22 and 23 are molded to secure the film circuit extending along the front face of the film circuit supporting member.

Film circuit supporting wall portions 24*f* of increased thickness in which the film circuit is also molded are formed at spaced apart locations aligned with portions 24*c*, as shown particularly in FIG. 4(*c*).

Mating pins and sockets 24*d*, *d'* and 24*e*, *e'* protrude from the front face at spaced apart locations along the base and end walls for mating engagement with complementary sockets and pins 25*e*, *e'* and 25*d*, *d'* of the other film circuit supporting member 25, to assemble the members in face-to-face relation.

The film circuits 22 and 23 are of the same type as the film circuits 12 and 13 and are assembled with the film circuit supporting members 24 and 25, respectively, to form unitary contact body structures using the molding in process to provide a continuous, longitudinally extending exposed strips between portions 24*c* and 24*f* and 25*c* and 25*f*, respectively, such exposed strip extending over the slots 24*b* and 25*b*, respectively. The film circuit is anchored (by in-molding) within portions 24*c*, 24*f* and the base of film circuit supporting member 24, for example extending in slack or curved condition across the slots 24*b* and 25*b*, respectively.

The two film circuit supporting members are then plugged together in face-to-face relation by engagement of the complementary pins and sockets to form a sub-assembly or main socket contact body.

Figure 5C:
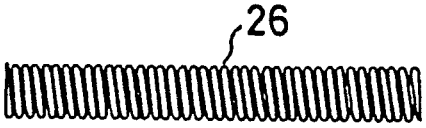

Coil springs 26, shown in FIG. 5, are then inserted in respective spring receiving slots 24*b* and 25*b*, being accommodated by the slack or curved portions of the film circuits, completing the assembly of the main socket contact body.

The sub-assembly so formed is then inserted, top leading, through the base into the housing 20, the locating flanges 24*a*, 25*a* seating against housing step 21*b*. The base member 27 is then inserted into the housing base between trailing ends of the respective film circuits, into engagement with the bases of the assembled film circuit supporting member members 24 and 25, respectively at locations spaced apart from downwardly tapered and upwardly recessed bottom edges of the side walls, by adhesive or welding to the end walls of the housing.

The receptacle 20 is then mounted on a surface of a base plate 28 formed with individual printed circuit paths with the individual circuit paths of the respective film circuit members extending out from the base of the housing in substantially coplanar alignment with the base plate to effect electrical contact with the respective individual circuit paths thereon.

The plug 10 is mated with the receptacle 20 by insertion into the mouth thereof until the free ends of walls of the plug housing channel section abut the shoulder 21*c* of the receptacle housing 21.

In the fully mated condition, shown in FIG. 6, the contact areas of portions of the film circuits 22 and 23 engaged by the springs 26 engage the contact areas of portions of the film circuits 12 and 13, respectively, which extend across the slots 14*b* and 15*b*, respectively, with resilient deformation of the coil springs into an elliptical shape, deformation being restricted by the walls of the slots 24*b* and 25*b*, respectively, and housing 21, so that a specific pressure is exerted between the main contact bodies of the plug and receptacle.

As the dimensional accuracies or manufacturing tolerances of the film circuits 12, 13, 22 and 23 are tighter than those of a rigid or discrete contact bodies there is minimal variation of the final contact pressure providing greater reliability of electrical connection.

The smooth surfaces of the film circuits obviate abrasion and scarification during mating, reducing wear and enabling numerous repeated reconnections or rematings, while connector stacking is facilitated by flexure of the film circuits. Furthermore, the risk of exposed epoxy fibers or sheared edges of stamped and formed metal contacts causing abrasion is obviated.

Formation of the main contact bodies as separate parts subsequently assembled, in particular, through the bottom of respective housings enables the pitches and widths of the conductive paths on the board engaging portions film circuit extending outside the housing to differ, in particular to be greater than those of the conductive paths contacts inside the housing, with a corresponding increase being possible in the pitch and width of the conductive paths on the base plate, facilitating alignment and reliable soldered connection thereto, as illustrated in FIG. 25.

Figure 34:
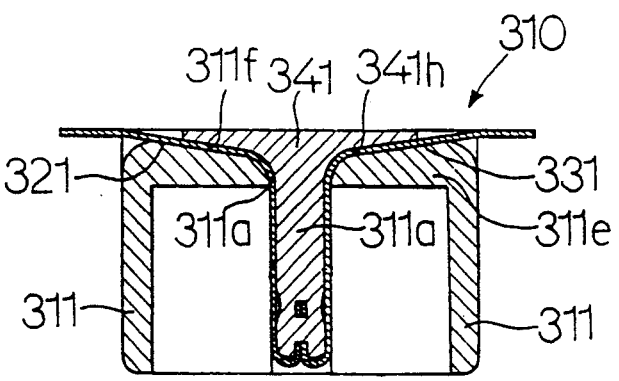
FIG. 34 is a cross-sectional view of the plug connector shown in FIG. 33.
Figure 35:
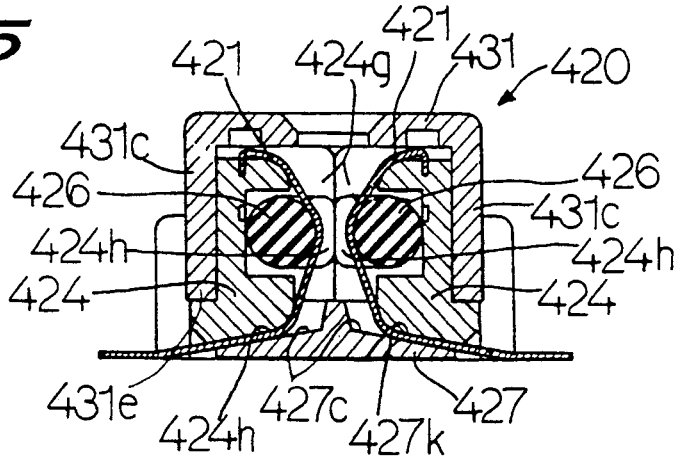
FIG. 35 is a cross-sectional view of the receptacle connector shown in FIG. 33.

In this example, the plug connector 310 is similar to that of FIG. 34 having a one-piece molded film circuit supporting member 341 inserted through an elongate aperture 311*a* in the base wall 311*e* of housing 311 clamping exiting film circuit between complementary lower and upper surfaces of the base wall 311*e* and foot 341*b* of the film circuit supporting member, respectively. Board engaging end portions 35 of conductive tracks film circuit 36 are stripped of insulation and are of greater width and pitch than contact area portions 37 within the connector.

In addition, the necessary conductive paths can be preformed with passive and active electrical devices installed directly onto the base plate itself.

Figure 43:
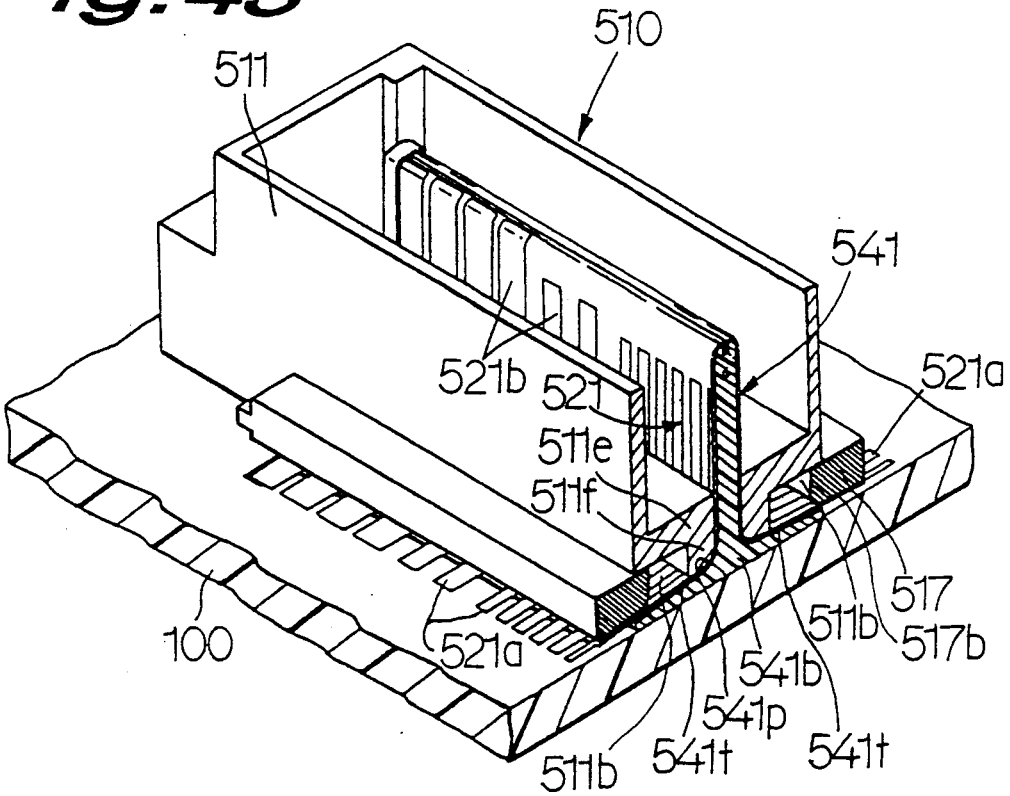
FIG. 43 is a perspective view, partly in cross-section of a further example of plug connector with film circuit pressing members aligned for insertion into the connector housing to flex the film circuit into engagement with the circuit board.
Figure 44:
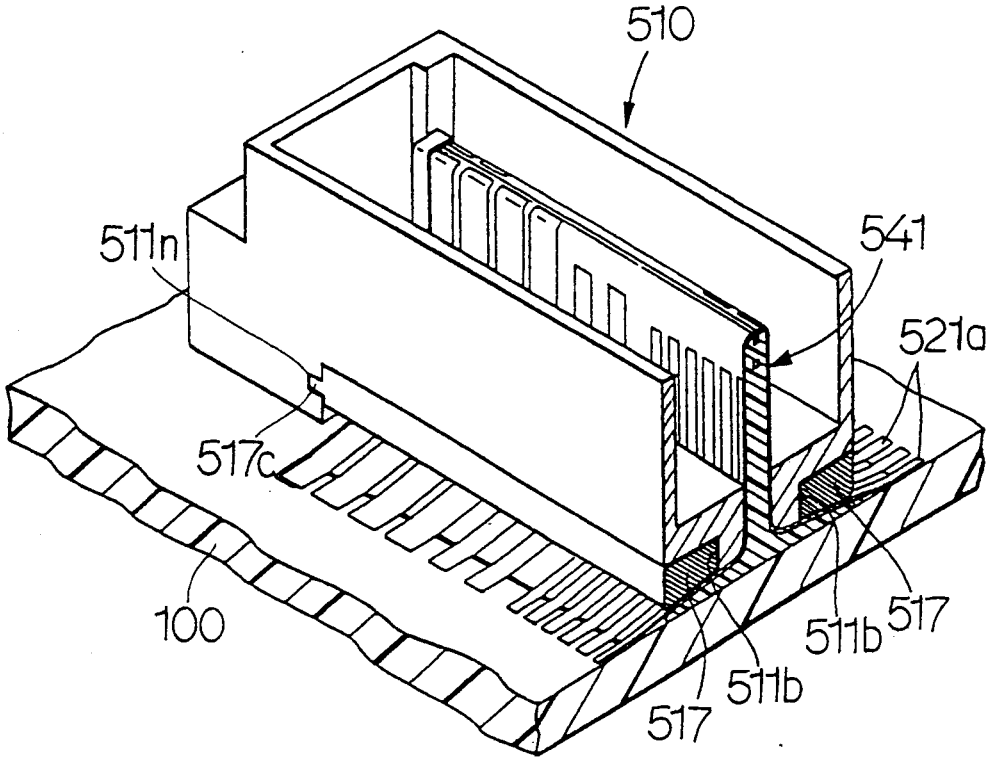
FIG. 44 is a similar view to FIG. 43 with the pressing members fully inserted in the housing, resiliently flexing the film circuit against the circuit board.
Figure 45:
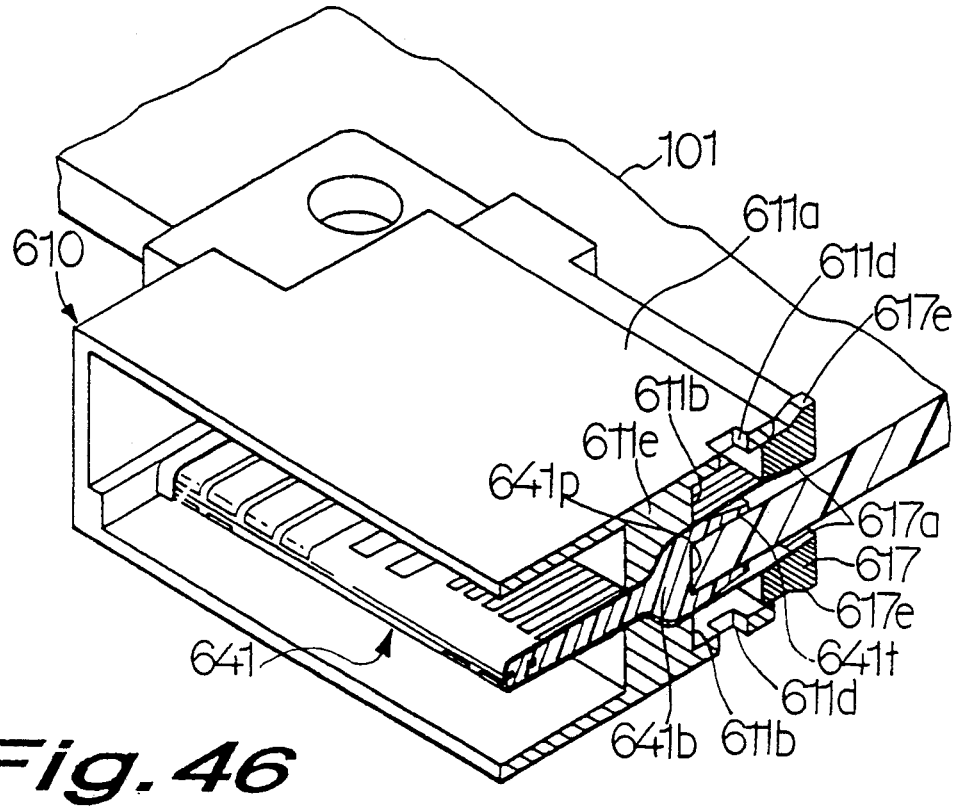
FIGS. 45 and 46 are views similar to those of FIG. 43 and 44, respectively, and showing a modified version of the plug connector with film circuit pressing members.
Figure 46:
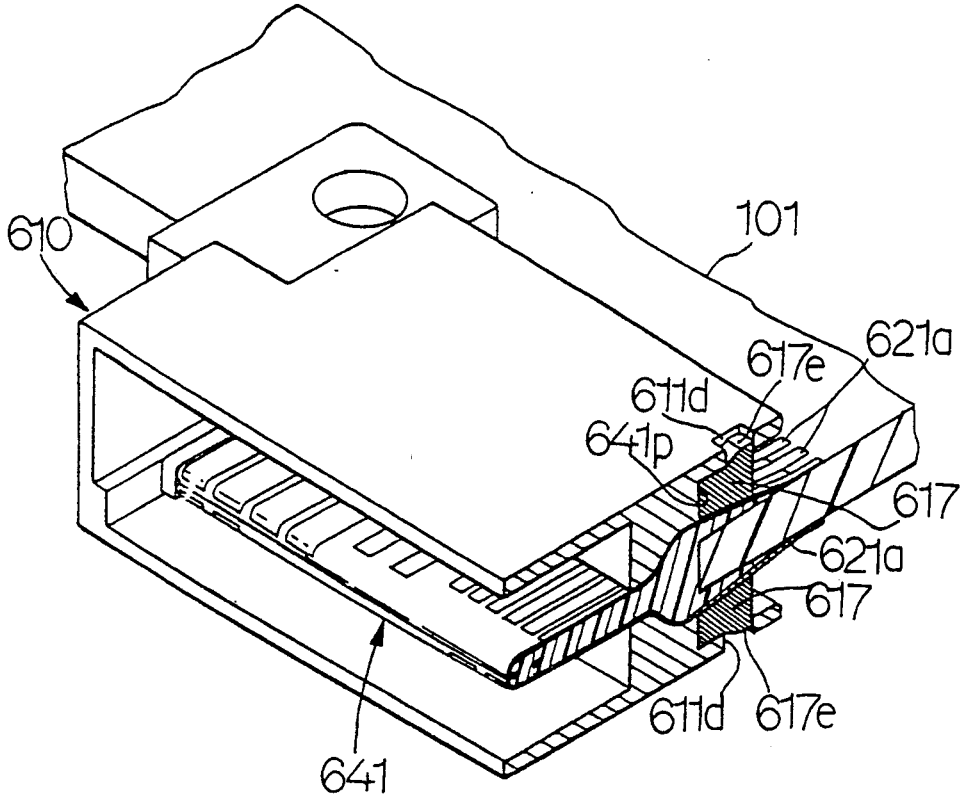

Furthermore, as shown in FIG. 43, also described in more detail below, the widths and pitches (separation) of the conductive paths within the connectors themselves can be different, selected for respectively different currents or voltages. Thus, characteristics of the connector can be selected by in-molding selected film circuits having conductive paths of different widths and pitches in otherwise identical film circuit supporting members and inserting the main contact bodies so formed in otherwise identical housings enabling a whole range of connectors for a variety of applications to be manufactured using only a single standardized housing configuration, affording extreme economy of manufacture.

The requirement to form the connector housings or film circuit locating members with contact locating ribs or channels dedicated only for a single contact configuration as normally required when using hard, loose-piece, contact members is obviated.

In the second example of socket connector 20', shown in FIG. 8(*a*)–(*c*), identical reference numerals have been used for identical parts, the only difference being in the replacement of helical coil springs 26 of the first example by a composite spring 36 formed by etching a longitudinal edge portion of a single thin strip 36*b* of stainless steel to define individual spring arms 36*a* and forming the respective arms into loops together defining a composite, radially defrayable, cylindrical spring body.

The residual strip portion may be trapped between the wall of the housing 21 and the respective film circuit supporting members 24 and 25, which may be rebated appropriately to accommodate the strip, thereby securing the loop portions 36*a* in the through slots 24*b* and 25*b*.

Figure 9:
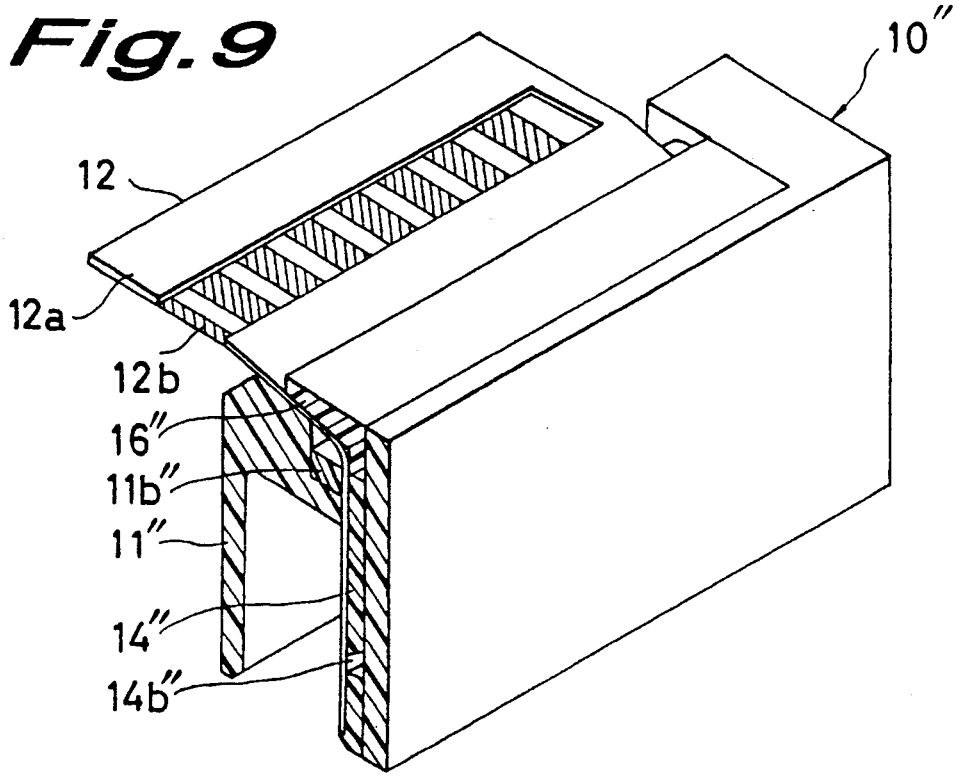
FIG. 9 is a similar view to FIG. 1 of a modified plug connector.
Figure 10:
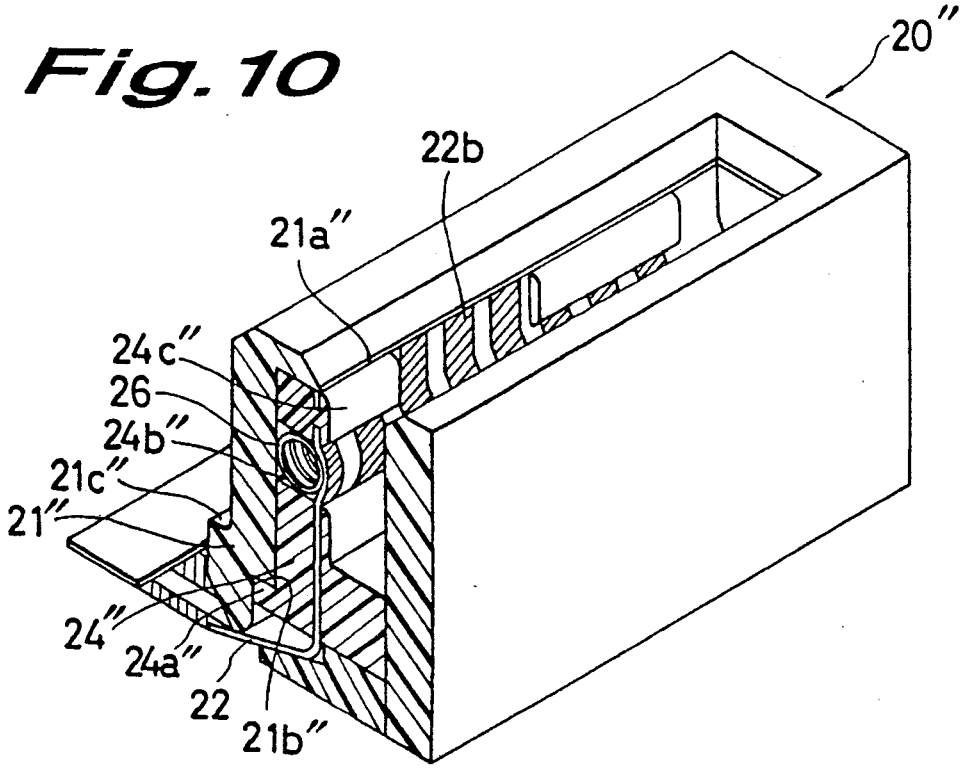
FIG. 10 is a similar view to FIG. 2 of a modified receptacle connector.

In the third example, shown in FIGS. 9 and 10, equivalent parts are identified by double primed reference numerals. In this example, only single main contact bodies 14" and 24" are mounted in plug and receptacle housings 11" and 21", respectively, which are each of correspondingly reduced width, being, essentially, bisected longitudinally. In these connectors, the film circuit supporting members are in engagement with longitudinal side walls of the respective housings, still molded in one piece, instead of engaging an identical, paired member as with the first example.

In another example, not shown the connectors may be essentially hermaphroditic, rather than of distinctly plug and socket, male and female, form and may also be provided with structures enabling them to be connected by butting together.

The springs exerting the contact force may be located in the plug connector instead of in the socket connector, or in both. The film circuits may be inserted into a mold as two separate parts, welded together, the covering end of the plug inserted into the receptacle with an insulating material, or removing the front side with a conductive metal foil and wrapping the film circuits about the film circuit locating members.

The plug housing 11 may also be of I-shaped cross-section, i.e. the longitudinal side walls omitted.

In the example of zero insertion force connector shown in FIGS. 11–20, many elements of the plug connector are of similar construction to those of the first example. Reference numerals 110–116 are therefore used for elements corresponding to elements 10–16, respectively, of the first example and closely similar parts will not, therefore, be described in detail.

Figure 11:
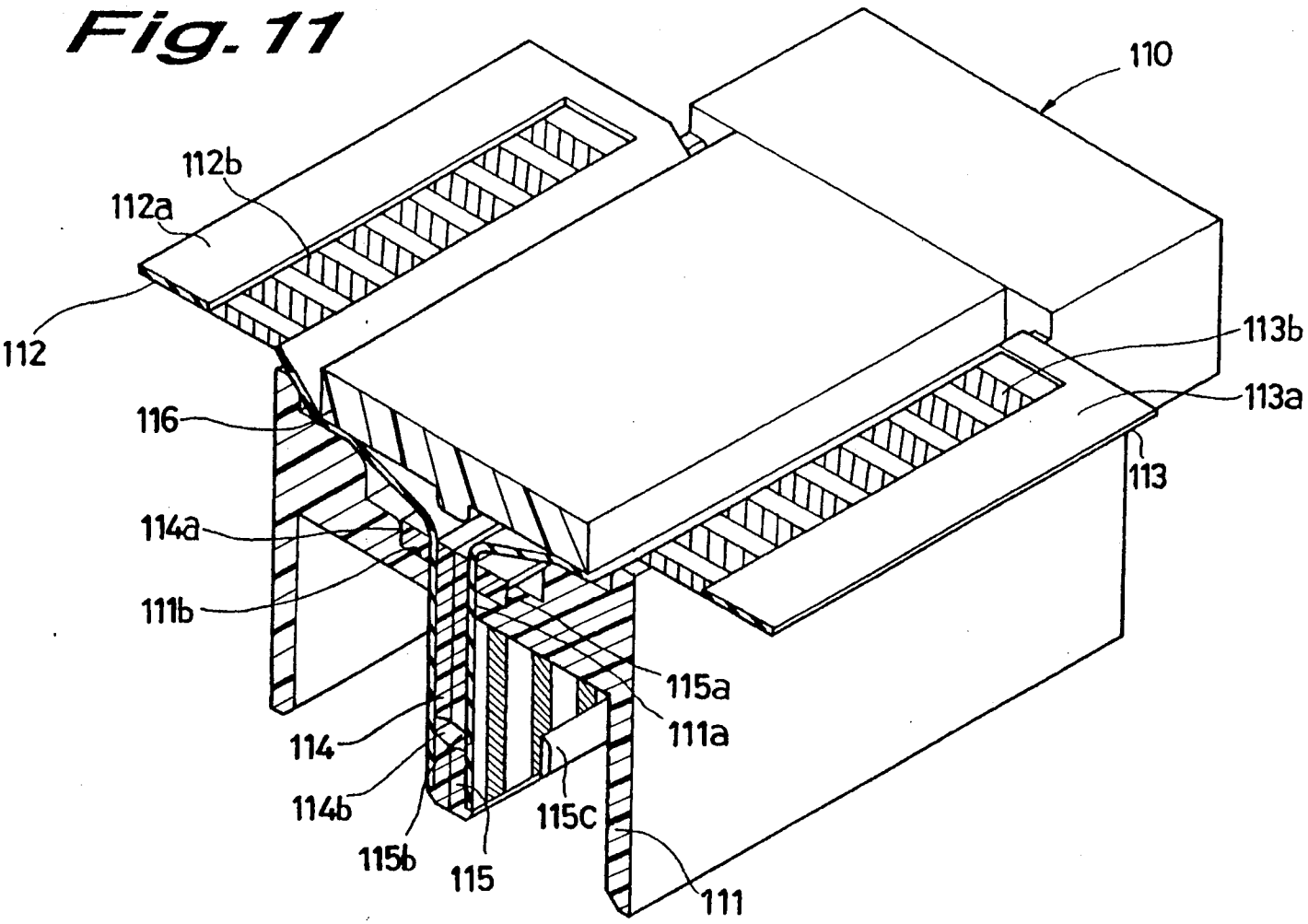
FIG. 11 is a perspective view partly in cross-section of a another example of plug connector according to the invention.

As shown in FIGS. 11, 13 and 15(*a*)–(*e*), the plug connector 110 comprises a housing 111 molded in one piece of plastic material, first and second circuit film circuits 112 and 113, respectively of L-shaped cross-section, first and second film circuit supporting and locating members 114 and 115, respectively, and, a base member 116 of generally T-shaped cross-section, as shown particularly in FIG. 15(*l*) and (*m*).

The housing 111 has base portions 111*c*, 111*c*' extending horizontally beyond both ends of a channel section defined by opposite side walls 111*d*, 111*d*'. Slot-form anchoring sockets 111*e*,111*e*' are formed in the upper surfaces of the base portions to extend transversely of the base at locations outside each end of the channel section. A pair of identical, plate-like clamping members 117, FIG. 15(*j*), (*k*), each has a leading edge portion formed with a bight 117*b* opposite edges of which are formed with series of aligned, arcuate camming and locking surfaces 117*a* which step progressively inwards as they extend away from the leading edge portion. The opposite end of the clamping member is formed with an anchoring land 117*c* receivable as a force fit in a slot-form socket 111*e* to upstand transversely from the base.

The longitudinal sides of recess 111*b* are outwardly stepped three times with the outermost step providing a horizontal seat for the base member 116, respective film circuits 112, 113 being gripped therebetween where leading out from the base.

The film circuit supporting members shown in FIGS. 11, 13(*a*),(*c*),(*d*) and 15(*f*)–(*c*), are similar to those of the first example, particular attention being drawn to the longitudinally spaced portions 115*c* of increased thickness providing castellations and the complementary pins and sockets 115*d* and 115*e*, locating the film circuit supporting members in back-to-back relation to form a unitary main contact body. It should be noted that the central contact body receiving slot 111*a* has edges castellated in complementary fashion to the castellations of the film circuit supporting members. In this example, the main contact body formed by the back-to-back assembly of the film circuit supporting members is mounted in the slot for limited sliding movement in a vertical direction to enable lost motion between the housing 111 and the film circuit supporting members 114, 115 during final stages of mating, as described below, and a clearance between the base member 116 and the first step of the recess is provided to accommodate such movement. The film circuit supporting members are normally biased in an uppermost position in which the feet or flanges 114*a*, 115*a* are seated in the first, uppermost, step of the recess 111*a* by the resiliency of the two film circuits 112 and 113, in the unmated condition.

Figure 12:
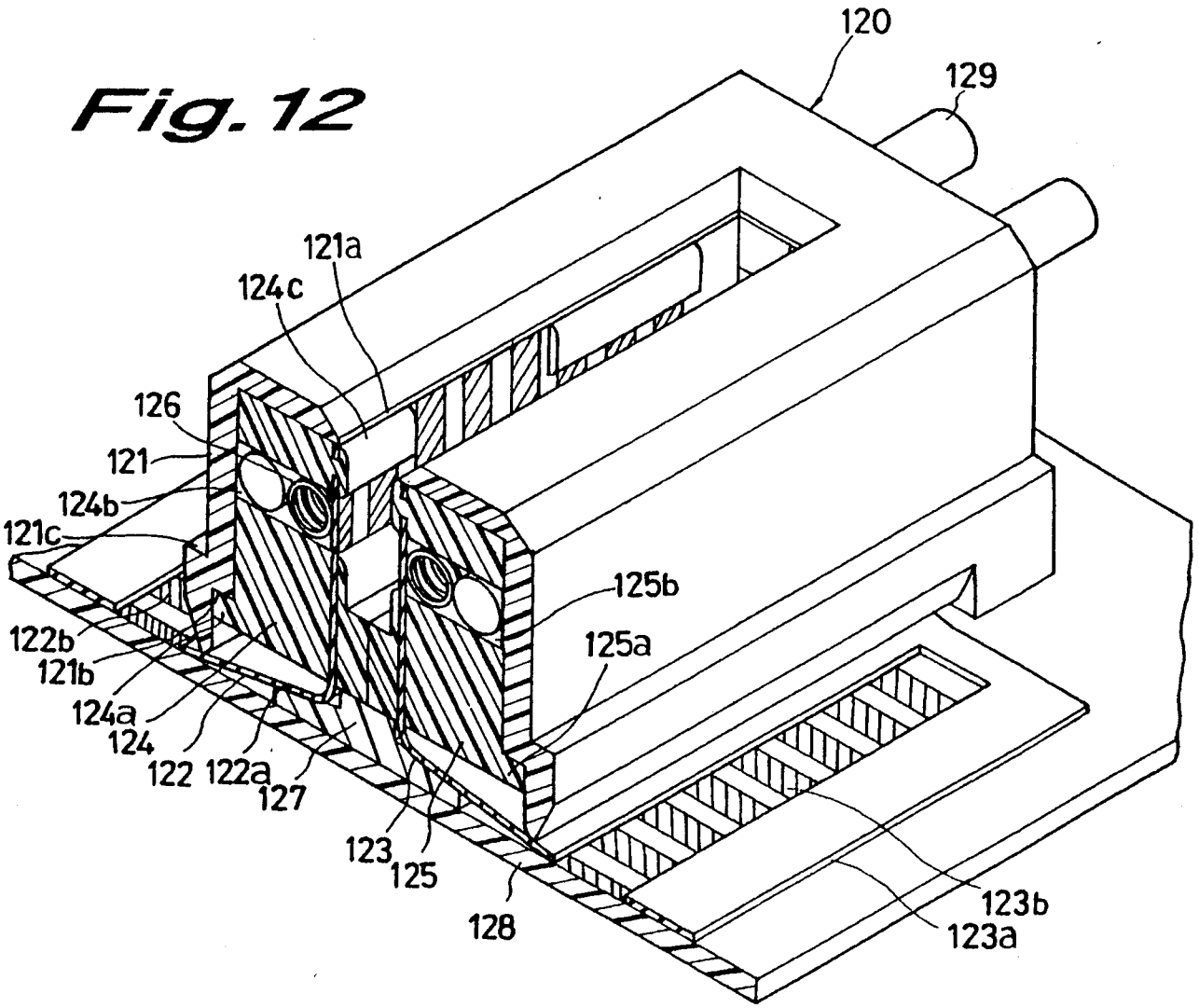
FIG. 12 is a perspective view partly in cross-section of a another example of receptacle connector according to the invention.
Figure 13A:
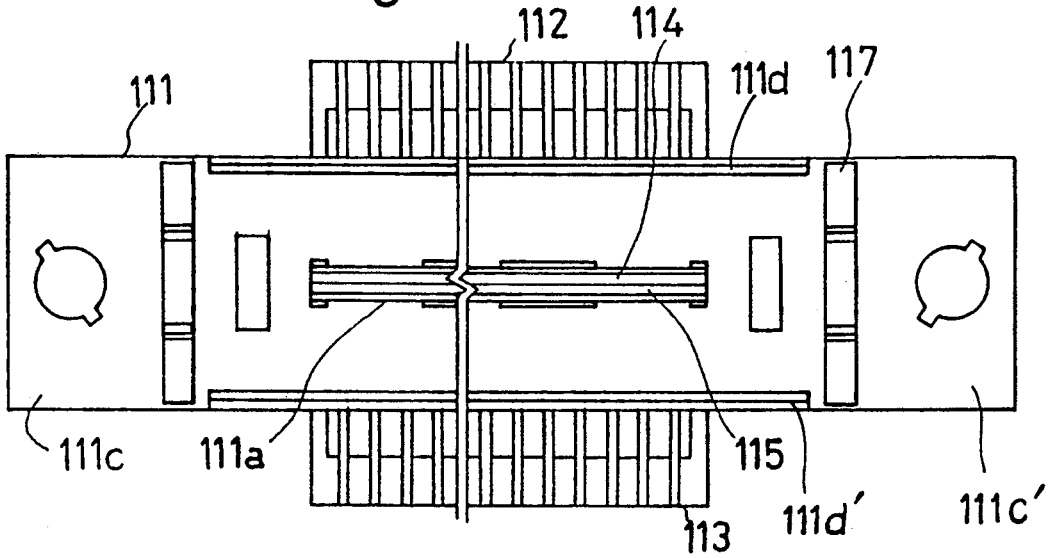
FIG. 13*a, b, c* and *d* are, respectively, plan, side elevational, end elevational and cross-sectional views of the plug connector of FIG. 11.
Figure 13B:
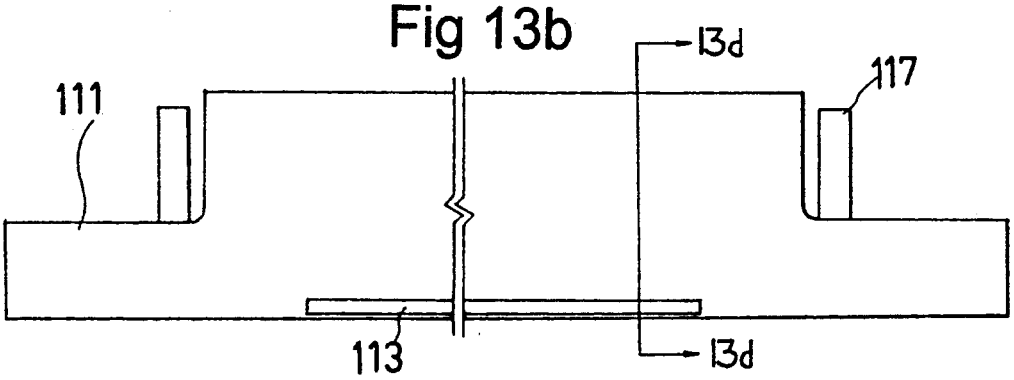
Figure 13C:
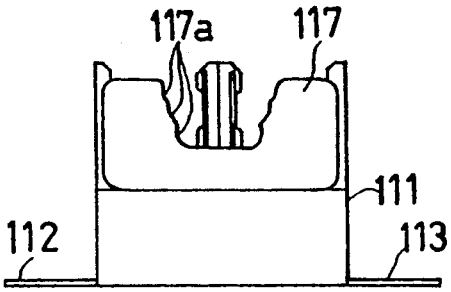
Figure 13D:
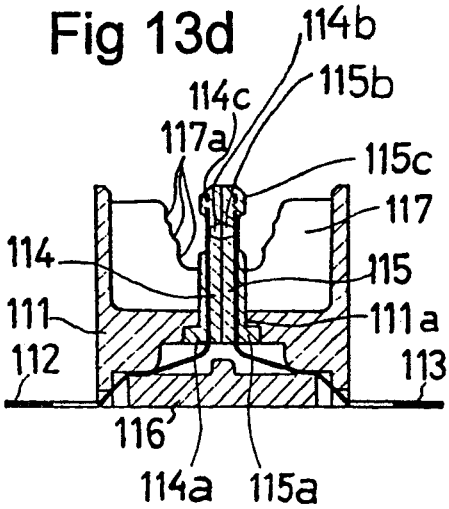
Figure 14A:
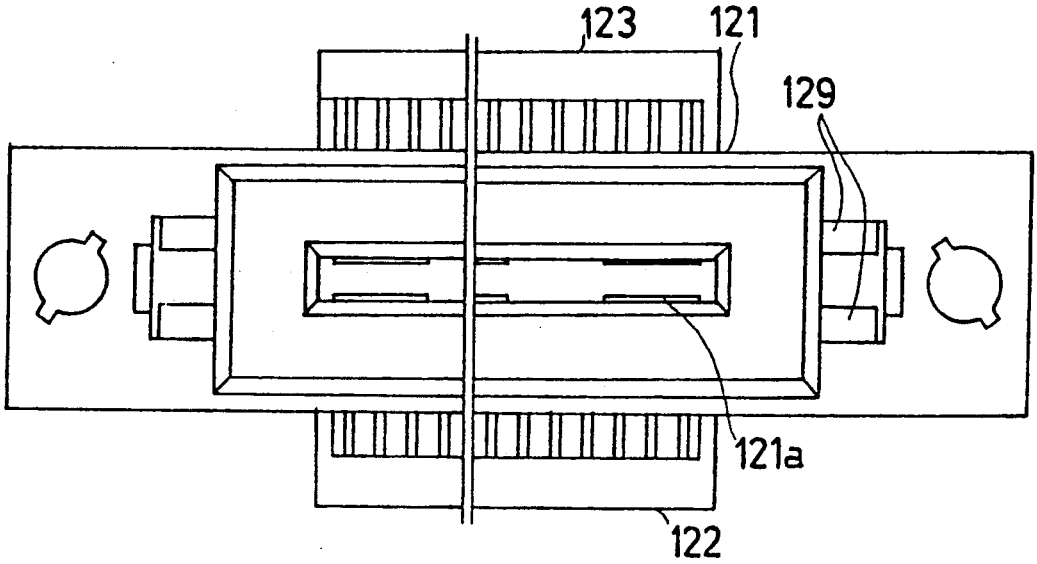
FIG. 14*a, b, c* and *d* are respectively, plan, side elevational, end elevational and cross-sectional views of the receptacle connector of FIG. 12.
Figure 14B:
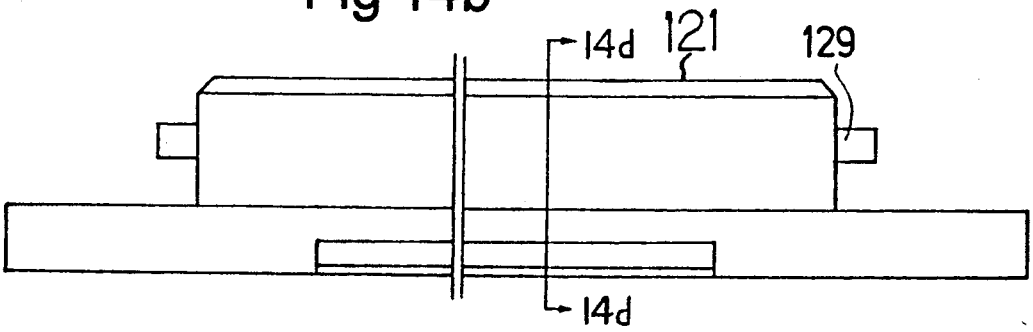
Figure 14C:
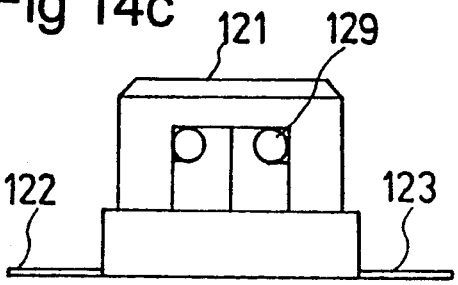
Figure 14D:
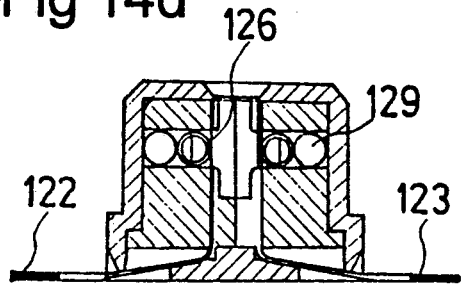
Figure 15F:
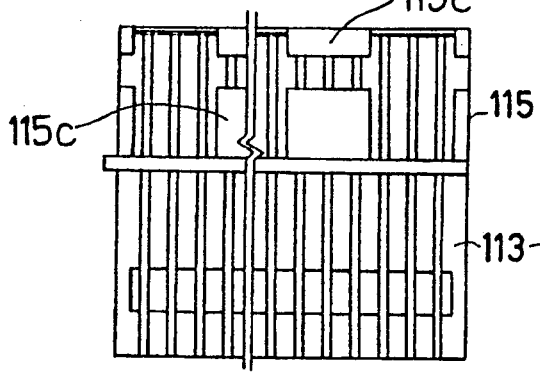
FIG. 15*a, b, c, d* and *e,* are respectively, plan, side elevational, partly in cross-section, underplan, end elevational and cross-sectional views of a housing of the plug connector of FIG. 11; and, f,g,h and i show, respectively, inside elevational, end elevational, outside elevational and cross-sectional views of a film circuit supporting member of the plug connector of FIG. 11; j and k show, respectively front elevational and side elevational views of a clamping plate of the plug connector of FIG. 11; and, l and, m show, respectively, plan and end elevational views a base member of the connector of FIG. 11.
Figure 15G:
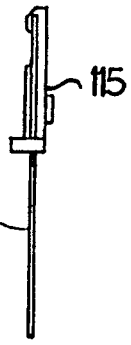
Figure 15H:
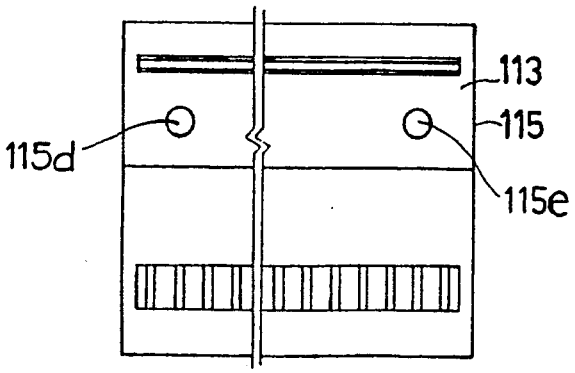
Figure 15I:
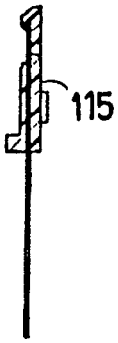
Figure 15J:
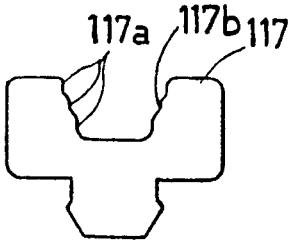
Figure 15K:
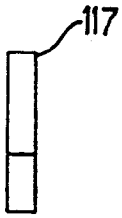
Figure 15L:
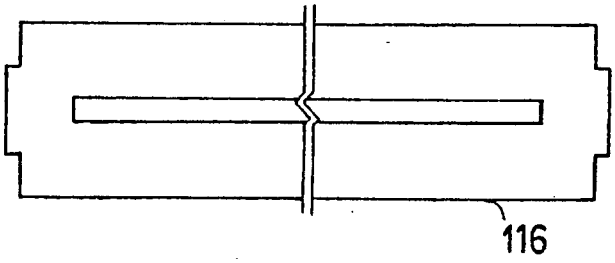
Figure 15M:
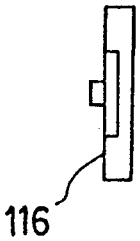
Figure 16A:
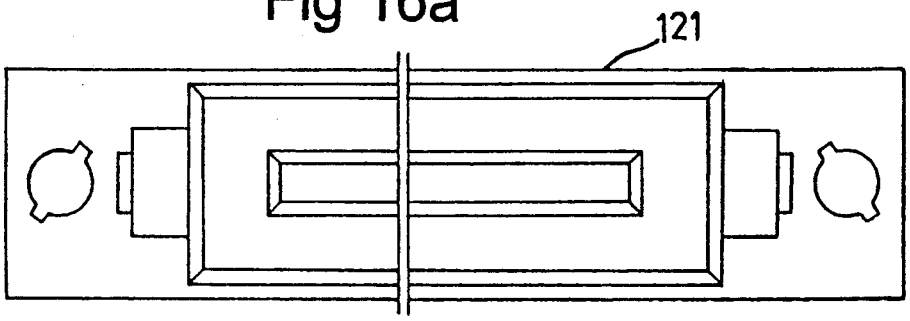
FIG. 16*a, b, c, d* and *e* are, respectively, plan, side elevational, underplan, end elevational and cross-sectional views of a housing of the receptacle of FIG. 12; f, g, h, and i are, respectively, outer elevational, end elevational, inner elevational and cross-sectional views of film circuit supporting member of the electrical connector of FIG. 12; j and k are, respectively, side elevational and end elevational views of a cam following and actuating rod of the receptacle connector of FIG. 12; l is a side elevational view of a coil spring of the electrical connector of FIG. 12; and, m and n are plan and end elevational views of a base member of the receptacle connector of FIG. 12.
Figure 16B:
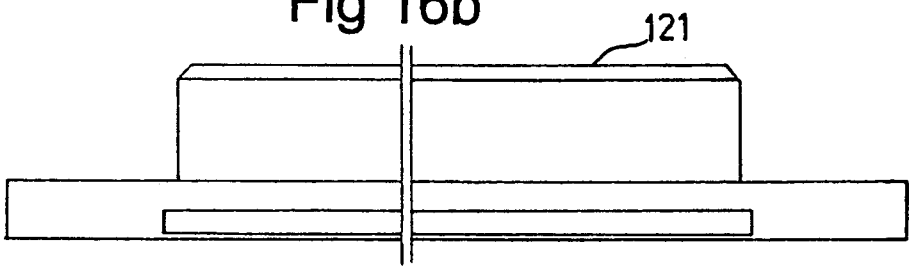
Figure 16C:
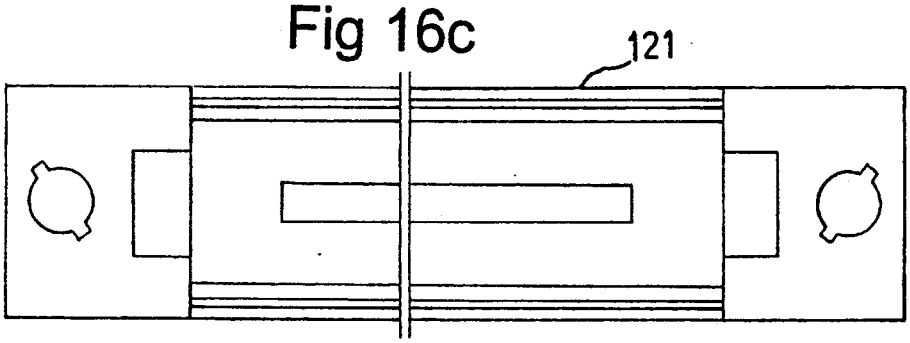
Figure 16D:
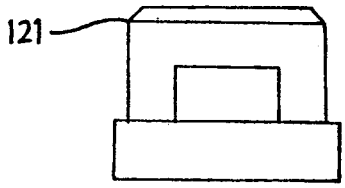
Figure 16E:
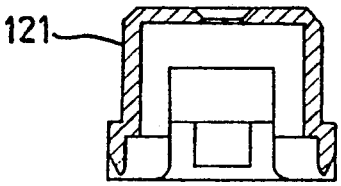
Figure 16F:
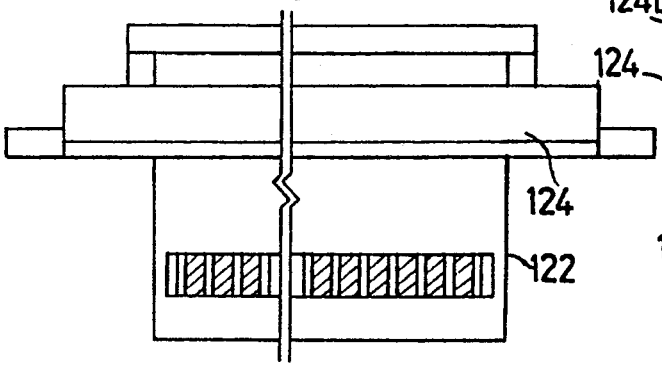
Figure 16G:
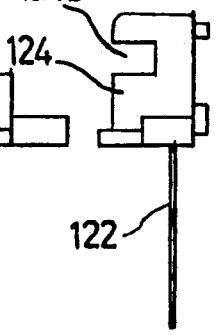
Figure 16H:
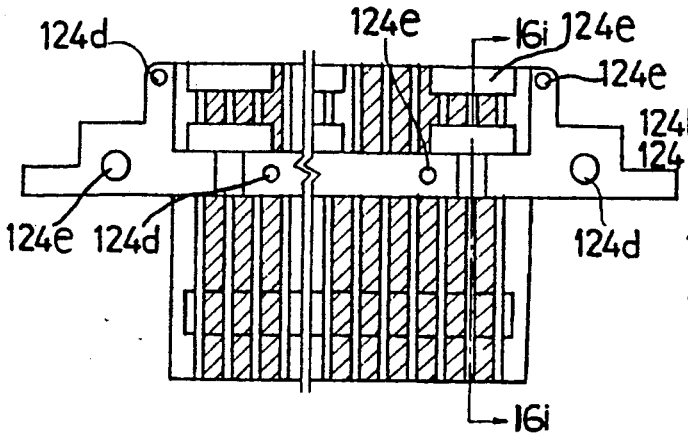
Figure 16I:
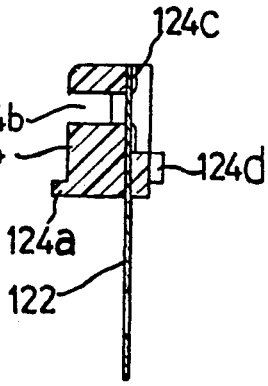
Figure 16J:
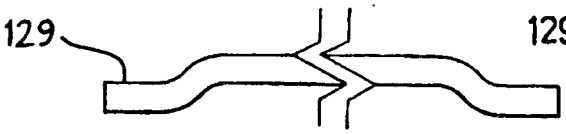
Figure 16K:
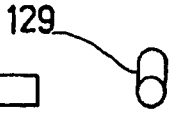
Figure 16L:
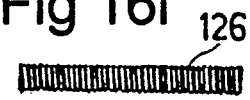
Figure 16M:
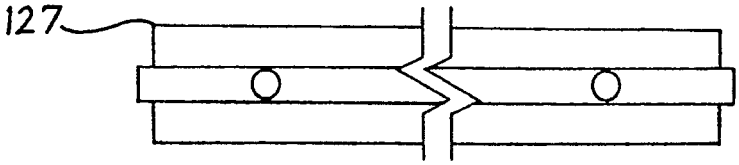
Figure 16N:
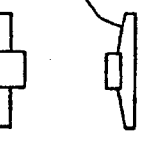

As many elements of the receptacle shown in FIG. 12 and FIG. 16(*a*)–(*c*) are also similar to those of the first example they are identified by reference numerals 120–126, corresponding to reference numerals 20–26 of the first example, and will not be described in detail.

A principal modification of the film circuit supporting members 124 and 125 is that they are approximately twice the thickness of the film circuit supporting members of the first example providing spring receiving through-slots 124*b* and 125*b*, respectively, of extended width to accommodate also respective cam following actuating rods 129 having cranked end portions locate behind respective springs 126, for transverse sliding movement therein.

The progressive stages of assembling the plug and receptacle are shown in FIG. 17(*a*)–(*h*), alphabetically successive pairs of Figures denoting successive stages of assembly.

Figure 17A:
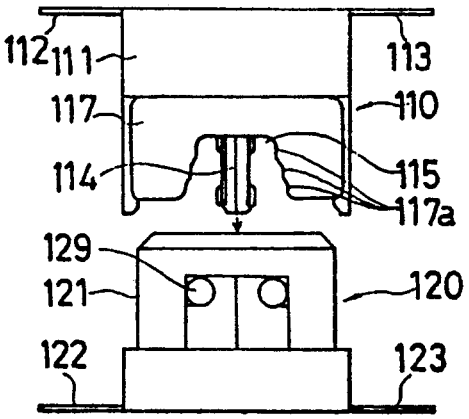
FIG. 17*a–h* are, successive pairs of end elevational and cross-sectional views of the connectors of FIGS. 11 and 12 at successive stages in mating.
Figure 17B:
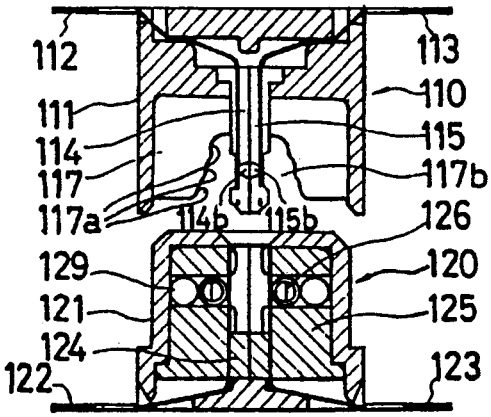
Figure 17C:
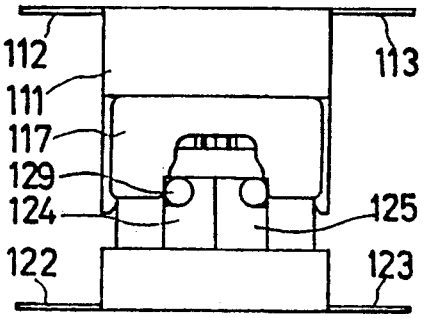
Figure 17D:
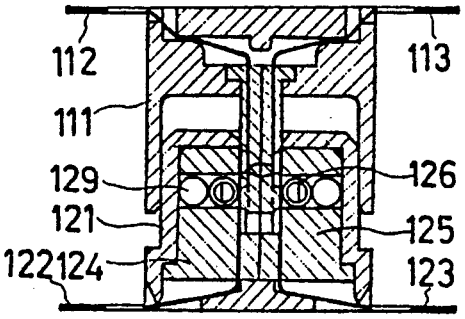
Figure 17E:
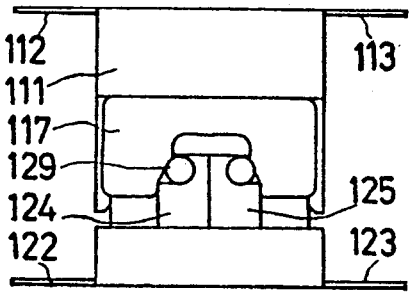
Figure 17F:
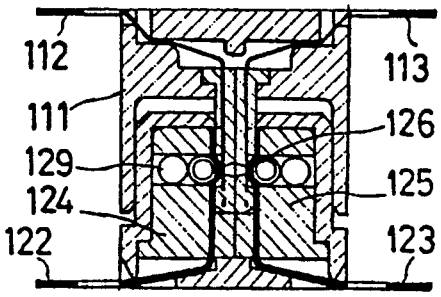
Figure 17G:
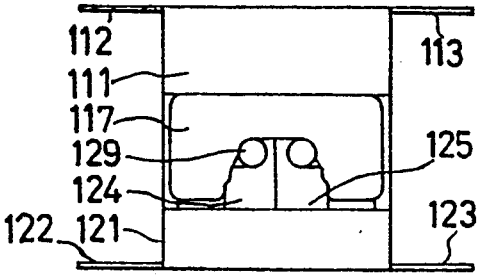
Figure 17H:
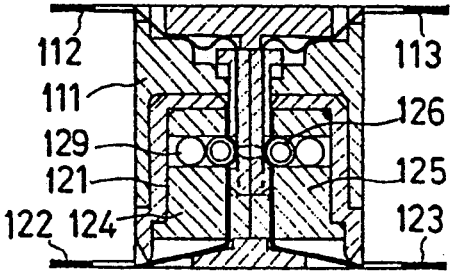

The plug and receptacle are initially aligned for mating as shown in FIG. 17*a* and *b* with the receptacle 120 installed on a base 128 not shown. The plug is then pushed progressively into the receptacle causing the cranked end portions of the cam following actuating rods 129 to be captured by the bights, (as shown in FIG. 16(*j*) and (*k*)), 117*b* of the respective clamping members 117 and, thereby cammed incrementally inwardly by engagement with successive stepped, arcuate camming surfaces 117*a*, urging the springs 126 inwardly with distension of the film circuit portions overlying the slots when the leading, head end of the plug passes clear of the spring receiving slots until the leading edges of the side walls 111*d*, 111*d*' abut the shoulders 121*c*, arresting the movement, as shown in FIG. 17(*g*) and (*h*).

Prior to engagement of the leading edges of the side walls 111*d*, 111*d*' with the shoulders, when the cam following actuating rods are in the penultimate camming steps as shown in FIGS. 17(*e*) and 17(*f*), the heads of the film circuit locating members engage the flanges 124(*a*) and 125(*a*) with lost motion between the heads of the film circuit and the plug housing during movement to the final position of the FIGS. 17(*g*) and (*h*), thereby ensuring that the film circuits 112, 133, respectively, of the plug member are aligned opposite the film circuits 122, 123, respectively, of the receptacle when actually brought into engagement. This assures that any relative transverse sliding movement of the film circuits is avoided, obviating risk of abrasion.

The clearance provided between the base member 126 and the feet 114*a*, 115*a* is taken up during such lost motion.

This construction provides a particularly reliable connection that can be repeated numerous times with the high dimensional accuracies of the film circuits ensuring minimal variation of contact pressure.

The necessary connection can be formed between the film circuits and the base plates with active devices installed thereon.

If necessary, the base portion of the connector can be sealed with an insulating material.

Clearly, the cam following actuating rods may be provided in the plug and the clamping and camming plates in the receptacle, or both camming and cam following elements in either the same plug or the same receptacle.

As shown in FIG. 18, in which elements identified by reference numerals 136(*a*), 136(*b*) correspond to those of 36(*a*) and 36(*b*) of FIG. 8(*b*), the above described alternative construction of spring may also be adopted in this example.

Figure 20:
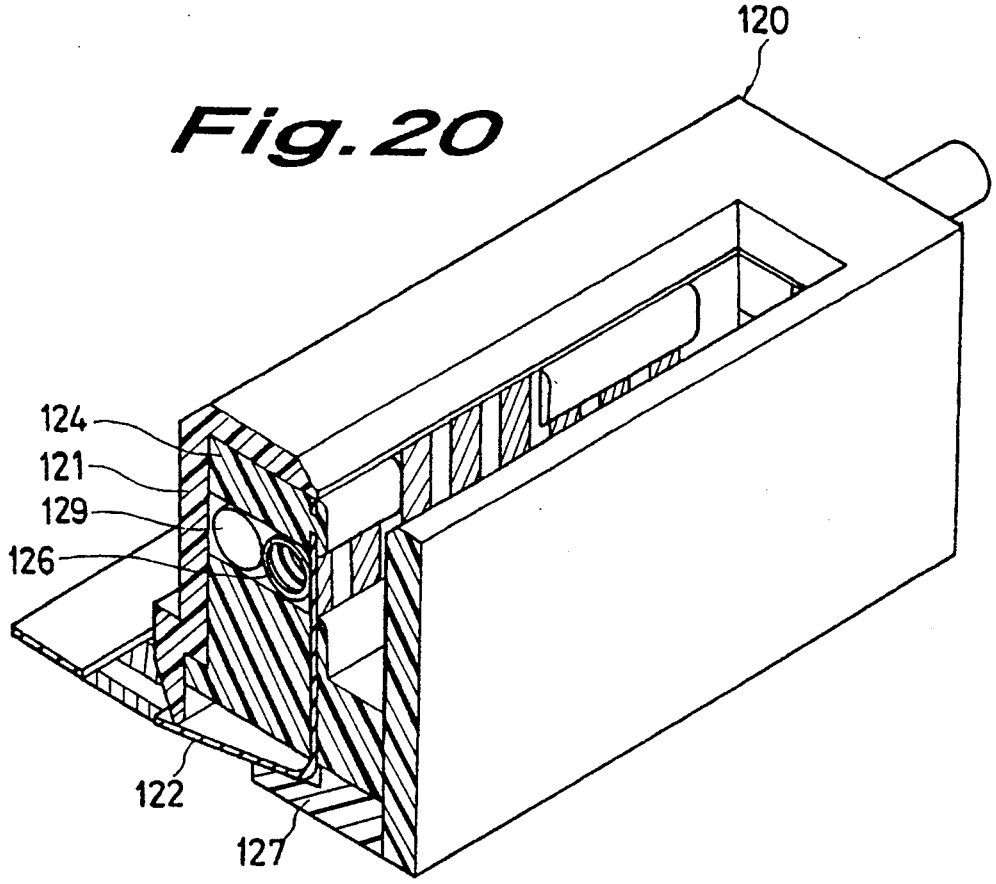
FIG. 20 is a perspective view partly in cross-section of a modification of the connector of FIG. 12.
Figure 21A:
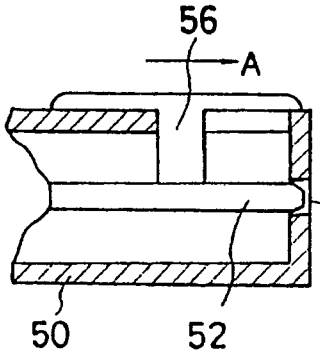
PRIOR ART Fig 21a
FIGS. 21*a,* 21*b* and 22 are cross-sectional views of one example of prior art connector assembly before and after mating, respectively.
Figure 21B:
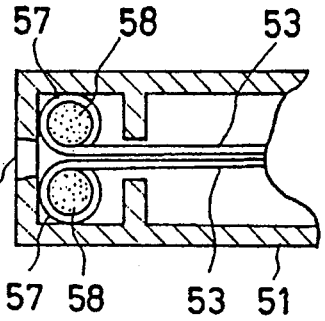
Figure 22:
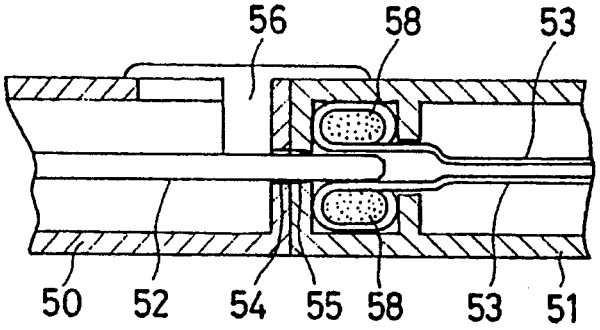
Fig. 22 PRIOR ART

As shown in FIGS. 19 and 20, each plug and receptacle of the zero insertion force connector may include only a single film circuit being constructed, in that respect in a similar manner to that of FIGS. 9 and 10.

In conventional film circuitry 82, shown in FIG. 24*e–h* the conductive paths are defined by a plurality of closely spaced metal or conductive ink tracks 82*b*, extending across the board engaging face of an insulating plastic web 82*a*.

As shown in FIG. 24*g* and *h*, when such metalized board engaging face is pressed against a circuit board 83, having discrete reflow solder pads 84 on respective individual conductive tracks 83*a* thereon, and the necessary heat applied, the reflowing solder is squeezed by the engaging metal surfaces onto areas of the web between adjacent tracks tending to cause unwanted solder bridges 85, short circuiting adjacent of the closely spaced tracks 82*b*.

In the film circuit 92 according to the invention, shown in FIGS. 23 and 24*a–d*, apertures 92*c* are formed in the insulating web 92*a* corresponding in size and location to the discrete reflow solder pads 84 exposing the metalized layers or tracks 92*b*, to the insulating web face, opposite to the conventional board engaging face, and forming individual solder receiving pockets or wells in which the discrete solder pads 84 are received when the film circuit is pressed insulating web face first, against the circuit board face. On reflow, the solder is trapped by the pocket walls defined by the edges of the apertures, remaining therein, thereby obviating risk of solder bridges and assuring reliable electrical connections.

The apertured film circuits are particularly suitable for use in the connectors described herein as, not only do the apertures enable accurate positioning of the film circuit tracks on those of the circuit board to be obtained by simply pressing the aligned film circuit against the circuit board so that the solder pads enter the pockets preventing the film circuit shifting across the board surface, but the confining action also avoids need for complex positioning apparatus during the reflow step. In addition, very close pitch of tracks on the film circuit ca be obtained without risk of solder bridge formation, enabling connectors having many circuit paths to be made in very small sizes.

In the plug and receptacle connector, for mating connector, the conductive tracks or paths are on the upper or outer face and lower or inner faces of the film circuits, respectively. Such film circuit therefore exits the plug connector with the insulating web towards the board, requiring that the connector normally be mounted with the mating face upstanding from the metalized surface of the board, wherein the base of the receptacle connector should be mounted in an aperture in the board with the mating face upstanding from the unmetalized surface as shown in FIG. 26*d*.

According to a further aspect of the invention shown in FIGS. 26*a* and *b*, a fastener 95, shown in the FIG. 26, can be used to secure the flexible circuitry extending from a connector to a circuit board.

The fastener 95 is molded in one piece of plastic with a rectangular head 95*a* and a generally cylindrical shank 95*b* formed with four beads 95*c* extending longitudinally thereof at equally spaced intervals around the shank periphery. The shank 95*b* is inserted through a locating aperture 12*a* in a film circuit 12 and received as a force fit in a locating aperture 96 in a circuit board 98 by engagement of the beads 95*c* with the walls of the aperture, thereby securing the film circuit on the board with the respective conductive tracks on the film circuit accurately positioned on the respective individual conductive tracks reflow solder pads on the board. Clearly, this ensures accurate and secure location of the board engaging film circuit portion exiting from the connector on the board in a rapid and inexpensive manner.

Figure 26C:
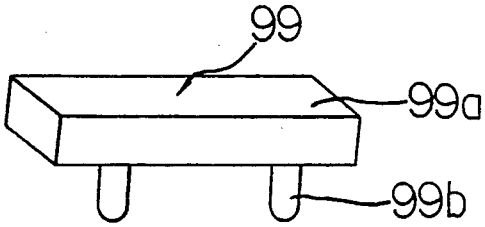
FIG. 26*c* is a perspective view of a second example of film circuit fastener.
Figure 26D:
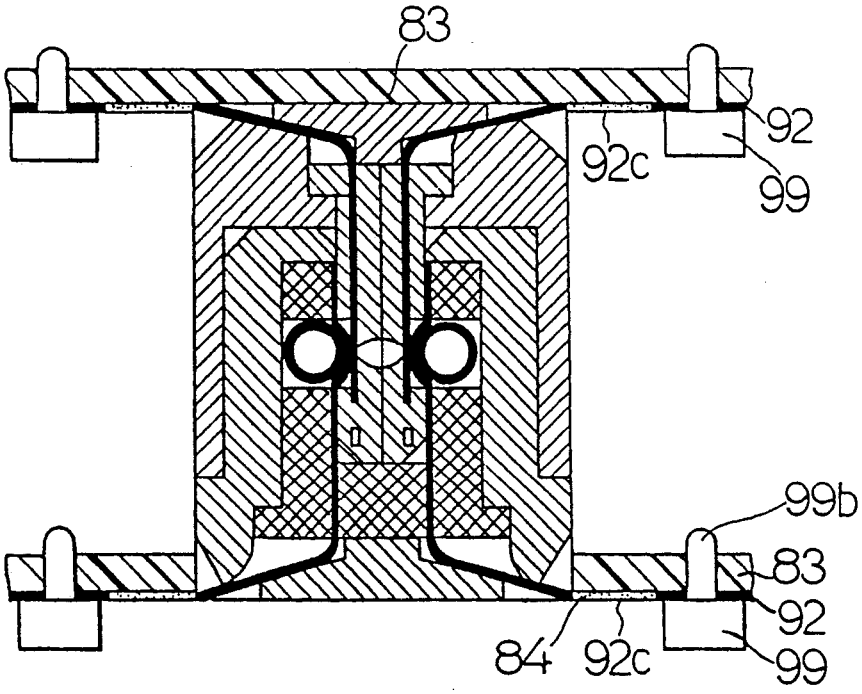
FIG. 26*d* is a cross-sectional view of a connector with fasteners securing an apertured film circuit to a circuit board.
Figure 27:
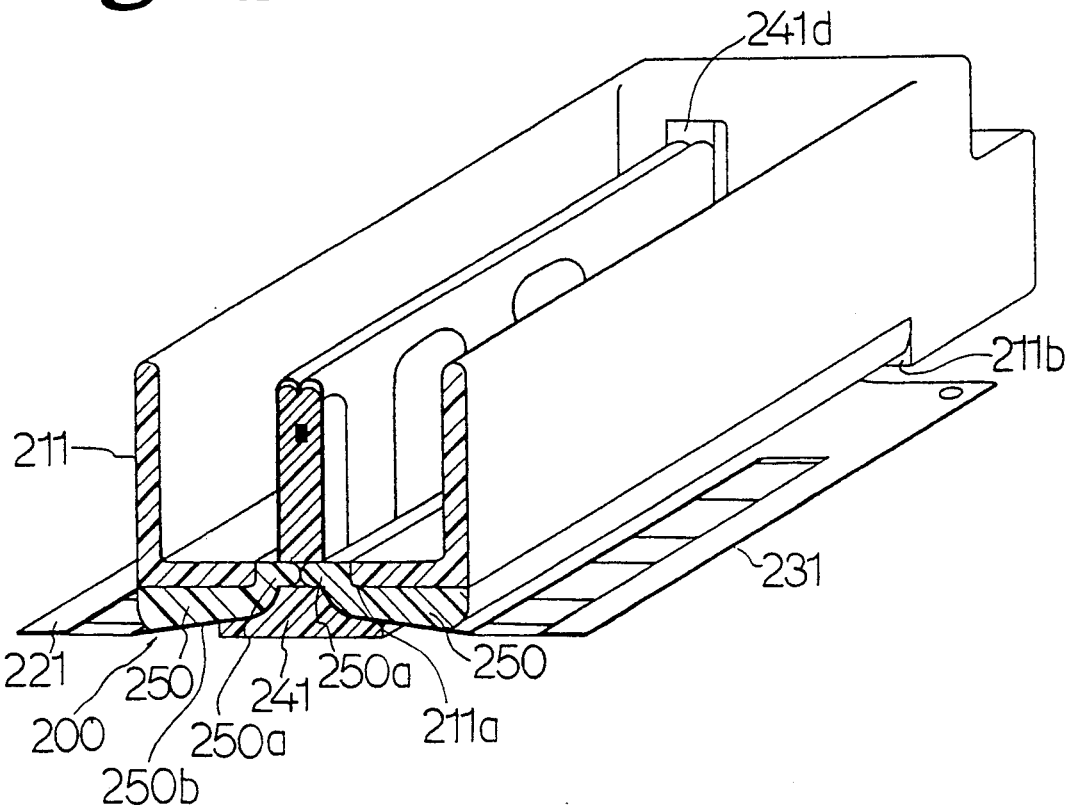
FIG. 27 is a perspective view, partly in cross-section of another example of plug connector according to the invention.
Figure 28:
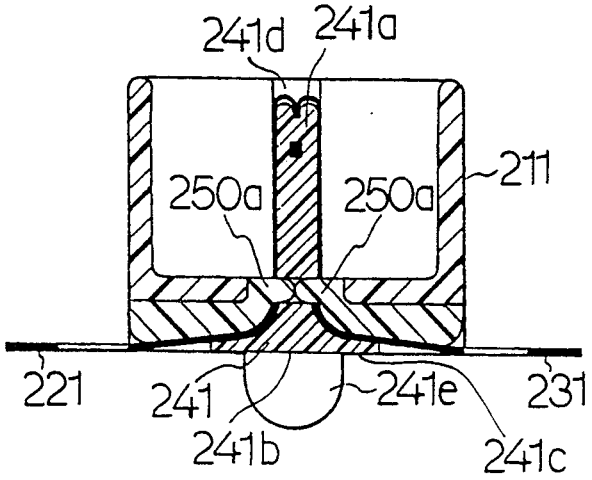
FIG. 28 is a cross-sectional view of the plug connector of FIG. 27.
Figure 29A:
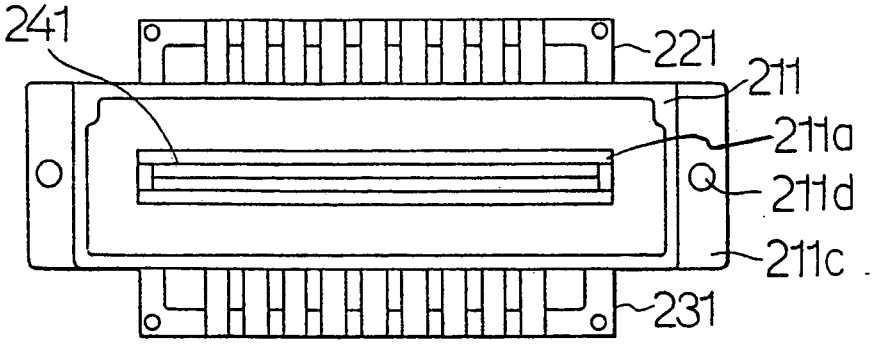
FIG. 29*a, b, c* and *d* are, respectively, plan, side elevational partly in cross-section, underplan, and end elevational views of the plug connector of FIG. 27.
Figure 29B:
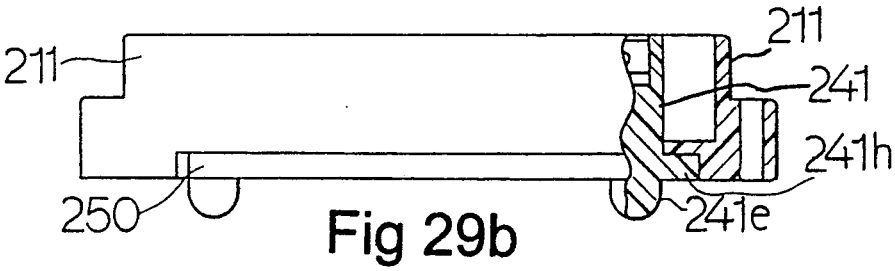
Figure 29C:
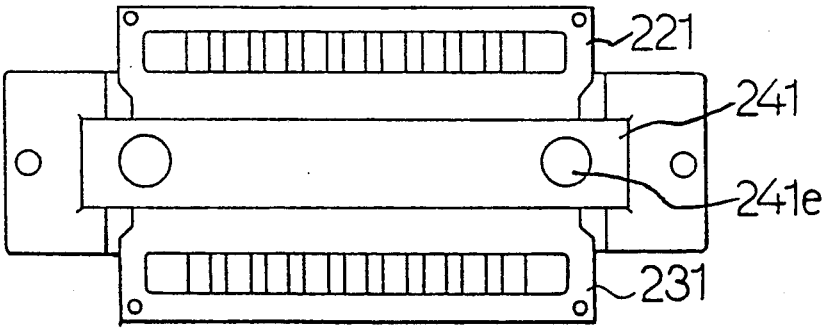
Figure 29D:
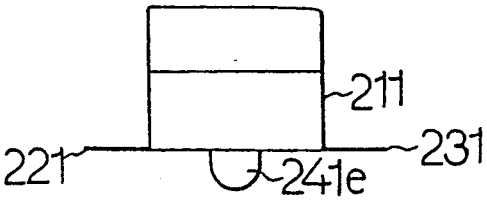

As shown in FIG. 26*c*, a modified fastener 99 has a head with two shanks 99*b*, similar in other respects to the previously described example.

FIG. 26*d* shows film circuits fully mated connectors having apertured film circuits according to the invention secured to circuit boards using the fasteners of FIG. 26*c*.

FIGS. 27–32 show an alternative example of plug connector 200 in which respective film circuits 221, 231 are assembled by an alternative method with a film circuit supporting member 241 for securement in a housing 211 by locating plates 250.

In this example, the film circuit supporting member 241 is a one-piece molding having a film circuit supporting wall 241*a* upstanding from a foot 241*b* formed by laterally extending, smoothly tapering, flange portions 241*c*, a transverse, film circuit locating upright 241*d* being formed at each longitudinal end of the wall. Board locating studs 241*e* are formed on the underside of the foot 241*b*. A row of locating peg receiving through-sockets 241*f* extend through the wall adjacent the foot and rows of film circuit accommodating recesses 241*g* are formed adjacent tops of opposite faces of the wall. Locating tongues 241*h* extend longitudinally from respective longitudinal ends of the adjacent the top.

Figure 30A:
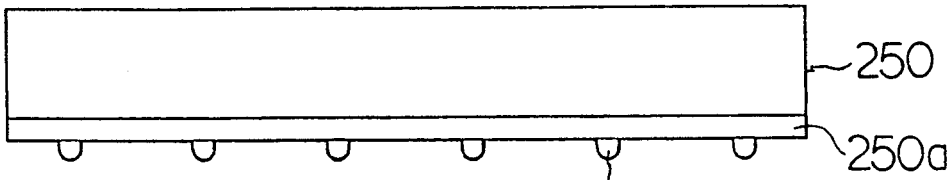
FIG. 30*a, b* and *c* are, respectively, plan, side elevational and end elevational views of a film circuit securing plate of the connector of FIG. 27.
Figure 30B:
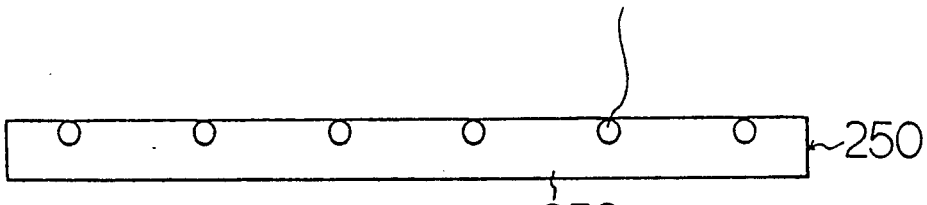
Figure 30C:
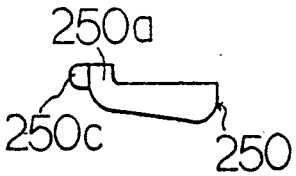
Figure 33:
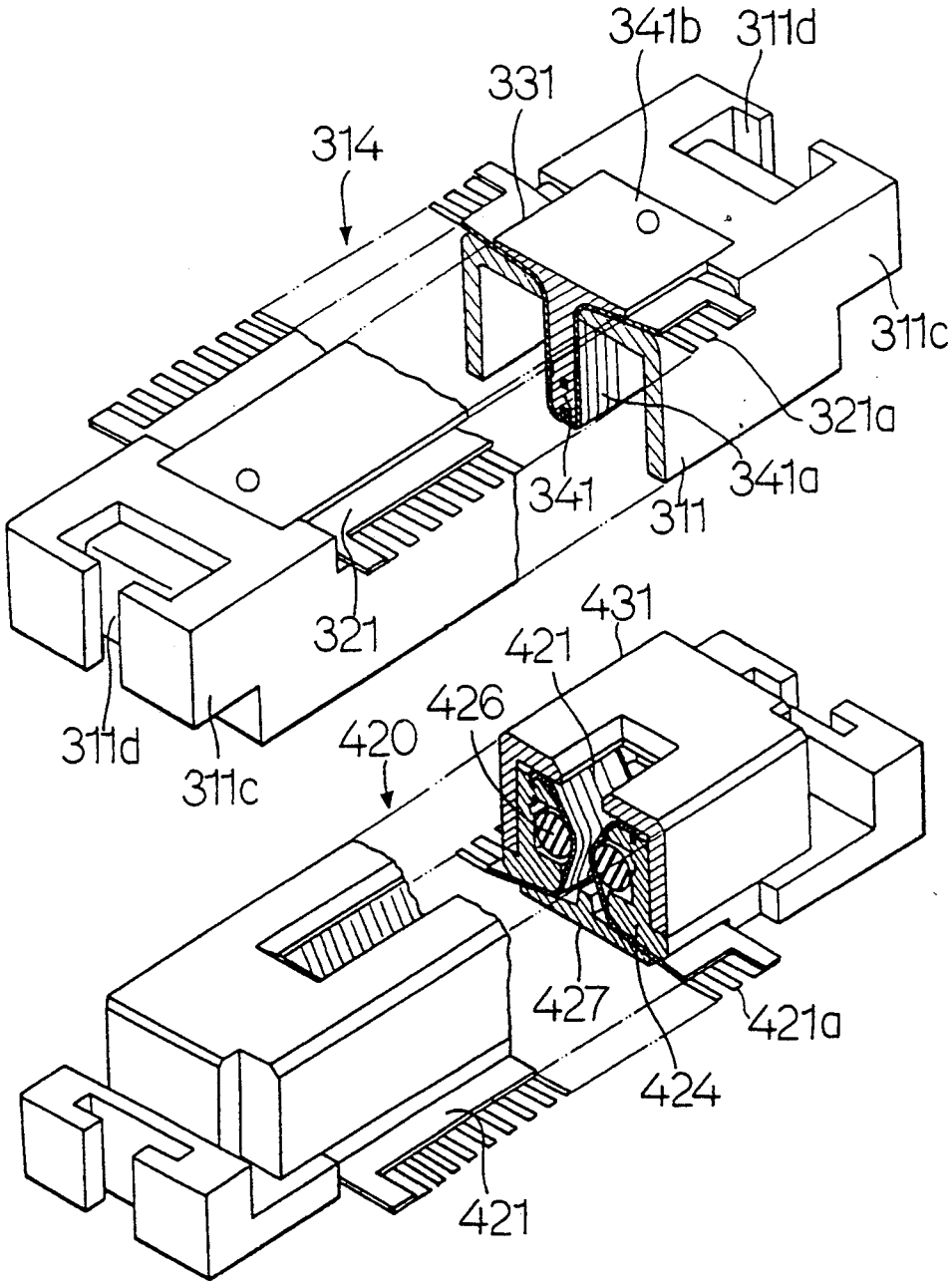
FIG. 33 is a perspective view, partly in cross-section, of a further example of plug and receptacle connector aligned for mating.

As shown particularly in FIG. 30(*a*)–(*c*), the film circuit locating plates 250 are identical, being rectangular in plan with a shoulder forming flange 250*a* extending along a longitudinal edge thereof. The outside, a lower surface 250*b* of the film circuit locating plates 250 tapers inwardly from a longitudinal edge remote from the shoulder and is chamfered at the shoulder. A series of film circuit locating pegs 250*c*, extend outwardly at longitudinally spaced apart intervals from outer longitudinal edges of the shoulder.

The housing 211 has a central part of channel-section with an longitudinal aperture 211*a* extending along a longitudinal center line thereof, a film circuit locating plate receiving rebate or recess 211*b* beneath the bottom wall 211*e* thereof and locating lugs 211*c* formed with board fastener receiving sockets 211*d* at respective longitudinal ends.

The film circuits are modified in the formation of rows of locating peg receiving apertures 221*a*, 231*a*, respectively, along medial locations and rows of anchoring apertures 226, 236 adjacent upper edges.

In assembling the main contact body, upper longitudinal edge portions of the two film circuits are abutted in face-to-face relation with the apertures 226, 236 in alignment and subsequently in-molded with the plastic material forming the film circuit locating member 241*a* to extend together vertically upwardly therefrom.

The respective film circuits are then reversely bent apart in opposite directions to extend down opposite faces of the wall 241*a* and secured adjacent the foot by inserting the locating pegs 250 through the respective apertures 221*a*, 231*a* into the respective sockets 241 so that the chamfered shoulders and outer surface of each film circuit locating plate 250 nests against the tapering upper surfaces of the feet. The sub-assembly so formed is then inserted into the longitudinal aperture 211*a* in the housing bottom wall 211*e* until the inner surface of each shoulder or flange 250*a* seats against the rim of the longitudinal aperture 211*a* and the plates 250 abut the bottom wall 211*a*. The assembly so formed may be potted or fixed in position using adhesive.

The examples of plug and receptacle 310 and 420 shown in FIGS. 33–42 are constructed to direct exiting board connection portions of the film circuits below a bottom of the housing so that stripped and separated portions of the film circuits resiliently flex into a soft engagement with the board with sufficiently low pressure to prevent solder paste pads on the board being crushed, as might otherwise occur by pressing rigid metal contacts against the pads to ensure good contact during reflow soldering while accommodating the relatively large tolerances arising from board warpage, thickness variations etc., obviating both undesirable solder bridge formation and board deformation.

The plug connector 310 comprises a housing 311, (FIG. 37(*a*)–(*c*)) having a central channel section portion with an elongate aperture 311*a* extending along the center of a bottom wall 311*e*. Opposite lower surface portions 311*f* of the bottom wall defining a film circuit locating member receiving rebate 311*b*, taper upwardly as they extend inwardly towards the aperture 111*a*. Lug portions 311*c* on respective opposite ends are formed with board mounting tab receiving slots 311*d*. Locating recesses 311*g* are formed at longitudinal ends of the rebate 311*b*.

Figure 37A:
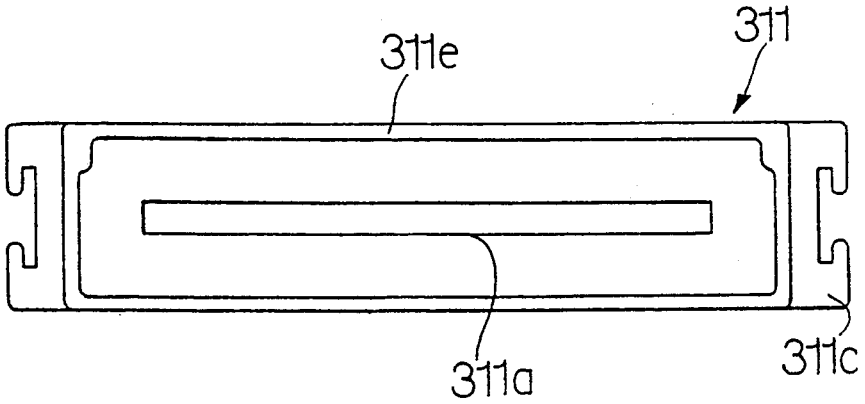
FIG. 37*a, b, c, d* and *e* are, respectively, plan, side elevational partly in cross-section, underplan, and cross-sectional views of a housing of the plug connector of FIG. 34 and a cross-sectional view of a film circuit supporting member of the connector of FIG. 34.
Figure 37B:
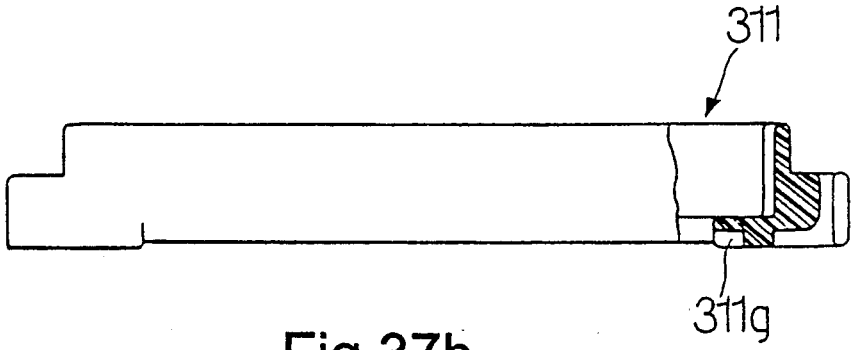
Figure 37C:
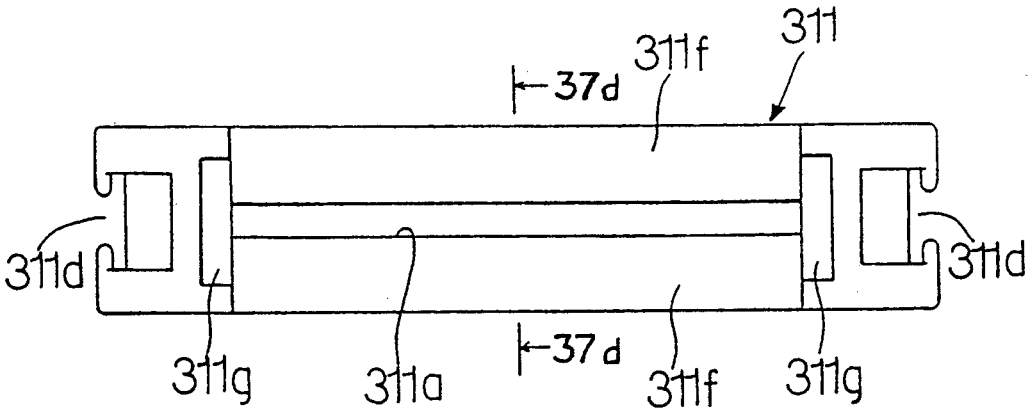
Figure 37D:
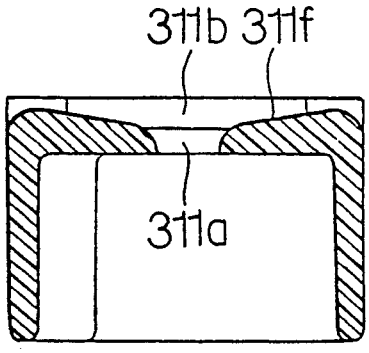
Figure 37E:
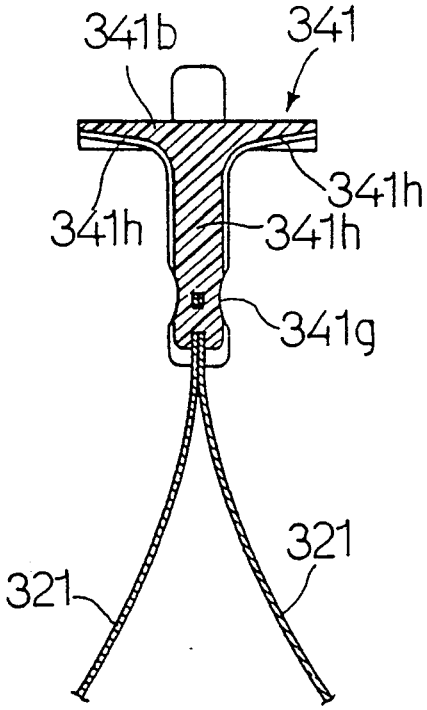

As with the previous example and, as shown in FIGS. 37*e*, film circuit supporting member 341 comprises a one-piece plastic molding having a wall 341*a* upstanding centrally from a flanged foot 341*b* tapering to opposite longitudinal edges to provide a smoothly contoured, upper film circuit supporting surface 341*h* of complementary contour to the lower surface portions 311*f* of the base wall. As above, aligned apertured ends of film circuits 321, 331 are molded in the top of the wall 341*a*, as shown in FIG. 37*e*, and the film circuits dressed down opposite faces of the wall and across the feet.

Figure 36:
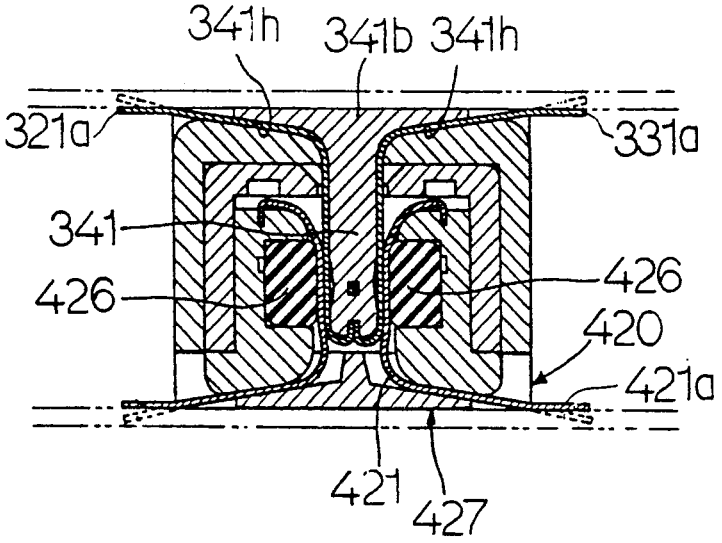
FIG. 36 is a cross-sectional view of the plug and receptacle connector of FIG. 33 mated together.
Figure 38A:
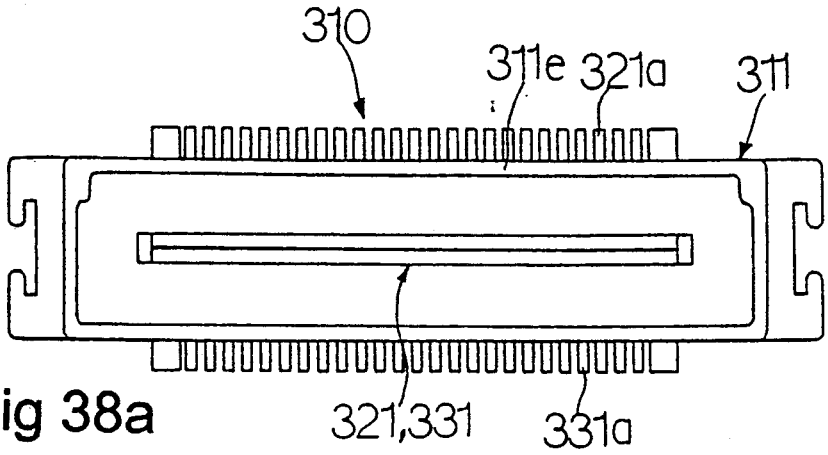
FIG. 38*a, b* and *c* are plan, side elevational, partly in cross-section and underplan views, respectively, of the plug connector of FIG. 34.
Figure 38B:
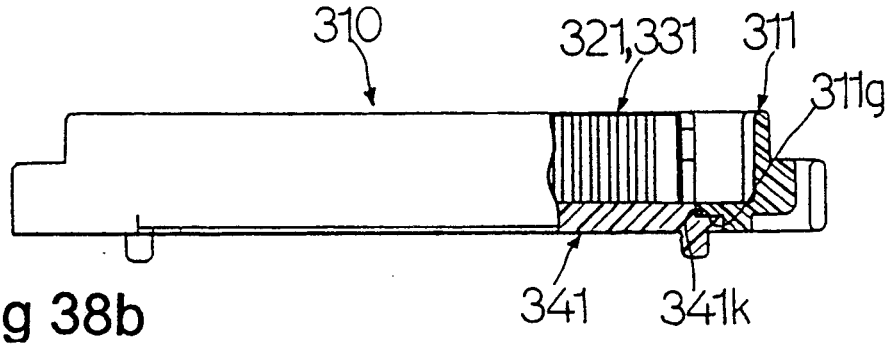
Figure 38C:
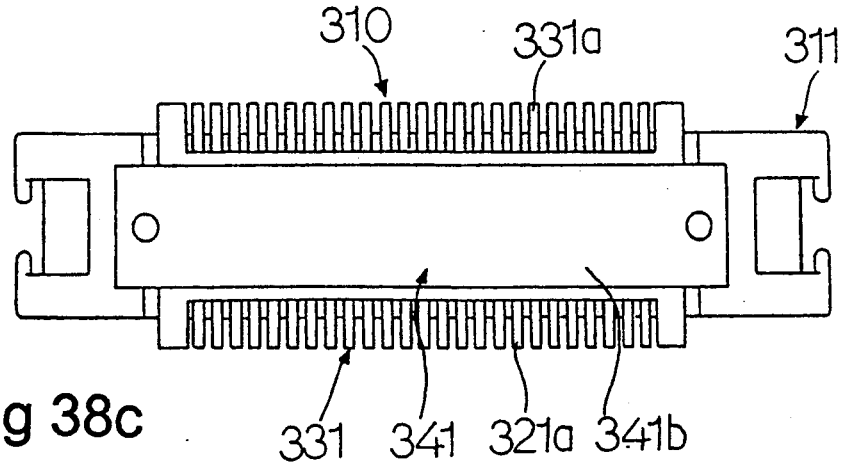

Assembly of the plug is completed by insertion of the wall portion of the sub-assembly of the film circuit supporting member 341 and the film circuit into the aperture 311*a* until protruding longitudinal ends of the film circuit supporting member are received as force fits in the longitudinal ends of the recess, particularly, in locating recesses 311(*g*), as shown in (FIG. 38(*a*)–(*c*)), with the film circuit trapped between the complementary surfaces 341*h* and 311*f* so that the stripped board connecting edge portions 321*a* are angled downwardly below a bottom surface of the housing, as shown in FIG. 36, for resilient flexure against a circuit board.

The receptacle connector 420, shown particularly in FIGS. 33, 35, and 39–41 comprises a one-piece housing 431 formed as a rectangular tube, identical film circuits 421, identical film circuit supporting members 424, a pair of cylindrical elastomeric members 426 and a base member 427 of generally inverted T-section.

Figure 39A:
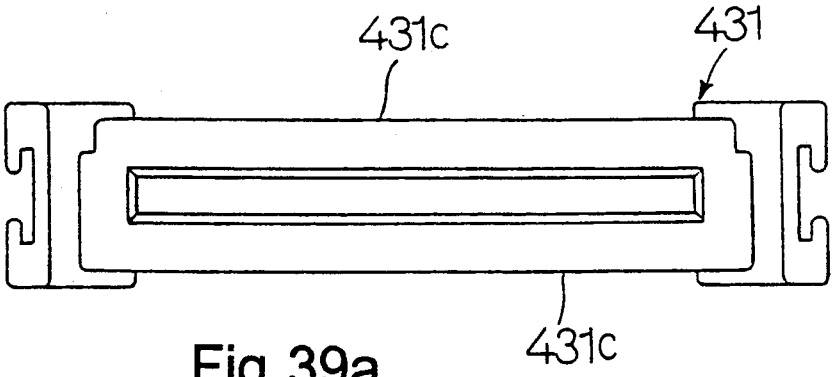
FIG. 39*a, b, c* and *d* are, respectively, plan, side elevational partly in cross-section, underplan and cross-sectional views of a housing of the receptacle connector of FIG. 35.
Figure 39B:
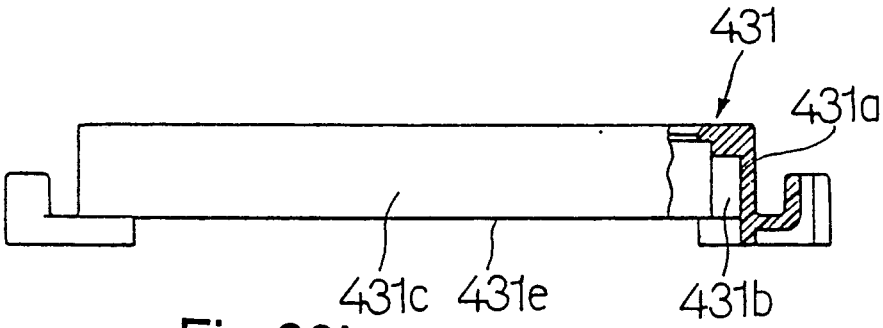
Figure 39C:
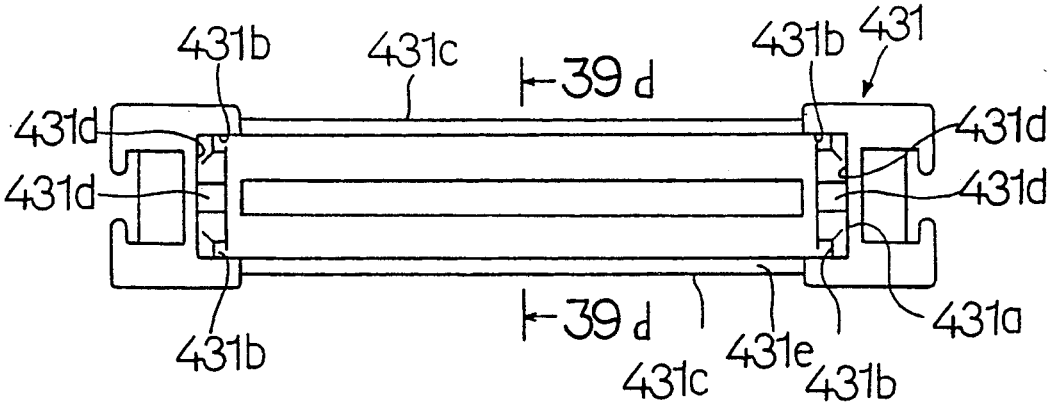
Figure 39D:
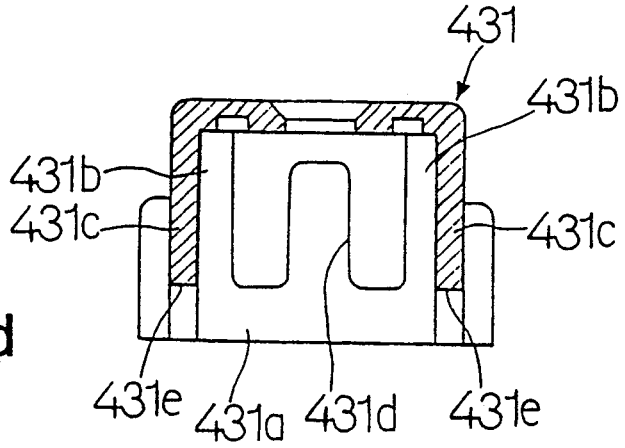

As shown particularly in FIGS. 39*b*, *c* and *d*, opposite end walls 431*a* of the housing 431 are each formed with a pair of downwardly opening, vertically extending film circuit supporting member locating grooves 431*b* at spaced apart locations adjacent respective longitudinal side walls 431*c* and a central, vertically extending, base member locating groove 431*d*. The lower edges 431*e* of the side walls 431*c* are rebated above the lower edges of the end walls.

Figure 40A:
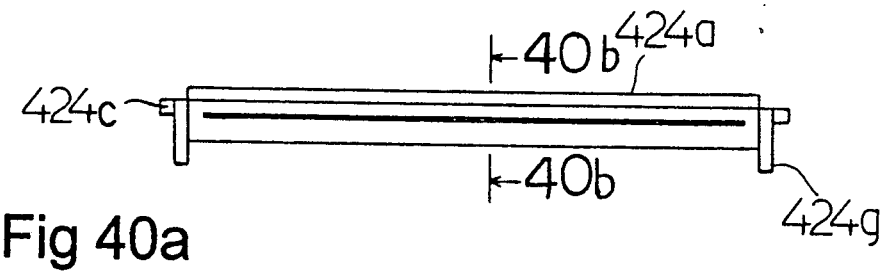
FIG. 40*a* and *b* are, respectively, side elevational and cross-sectional views, of a film circuit supporting member of the receptacle member of FIG. 35.
Figure 40B:
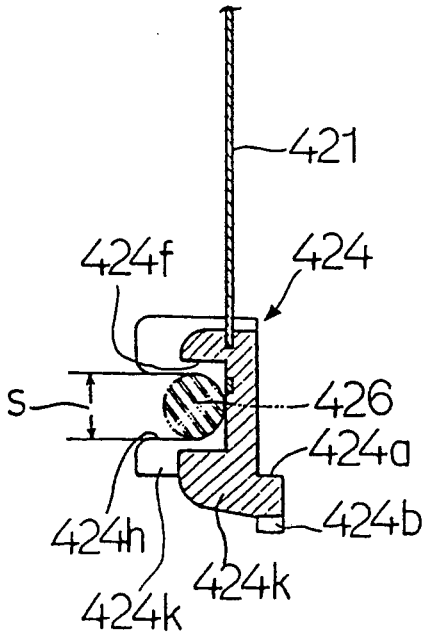

As shown particularly in FIGS. 40(*a*) and (*b*), each film circuit supporting member 424 comprises a rectangular block formed with a rearwardly protruding flange 424*a* or ledge engageable with the lower edges 424*e* of the side walls and downwardly directed locating projections 424*d* extend from respective opposite ends.

An elastomeric member receiving groove 424*f* is formed in the front face in alignment with elastomeric member retaining slots 424*h* of widths Slightly less than the diameter of the elastomeric member 426, formed in flanges 424*g* extending from respective opposite ends thereof. Locating projections 424*i* engageable in grooves 431*b* extend longitudinally from respective opposite ends. A lower film circuit clamping surface 424*k* curves progressively to provide a convex clamping surface as it extends rearwardly from the groove 424*f* to the projection 424*b*.

Figure 41A:
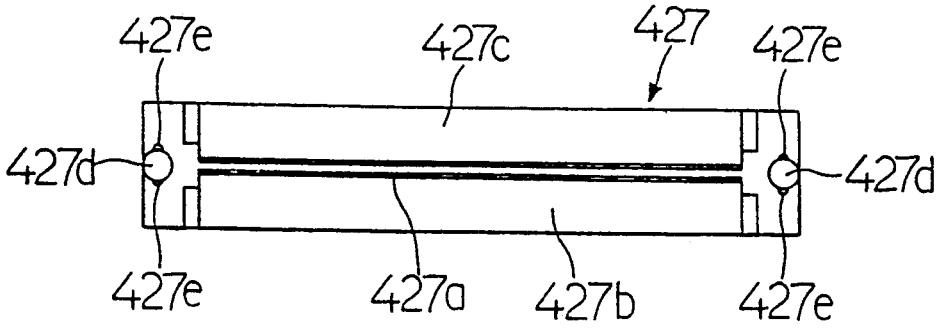
FIG. 41*a, b* and *c* are, respectively, plan, side elevational and cross-sectional views of a base member of the receptacle member of FIG. 35.
Figure 41B:
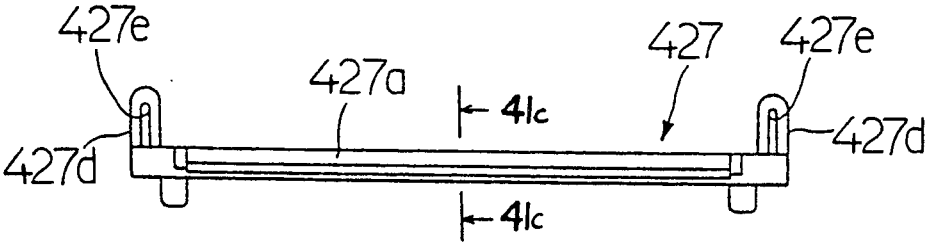
Figure 41C:
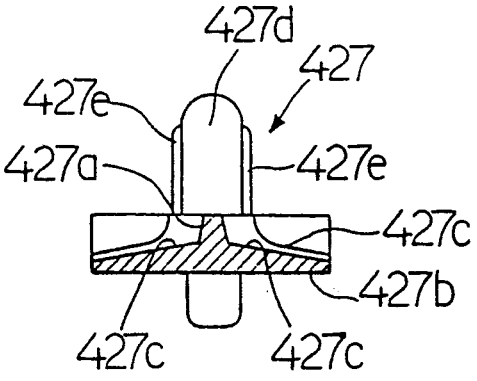
Figure 42A:
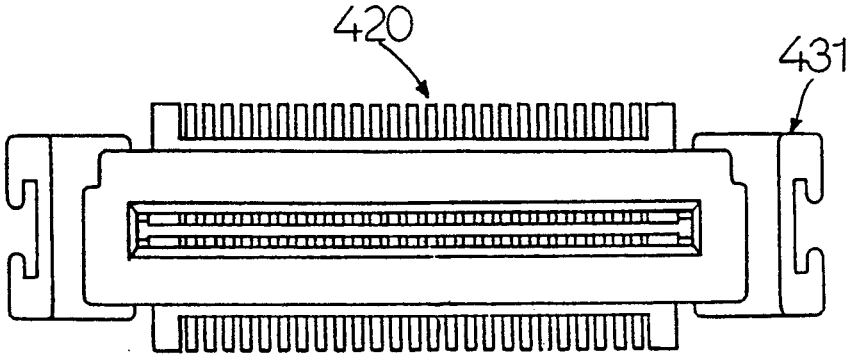
FIG. 42*a, b* and *c* are, respectively, plan, side elevational and partly cross-sectional and, underplan views of the receptacle connector of FIG. 35.
Figure 42B:
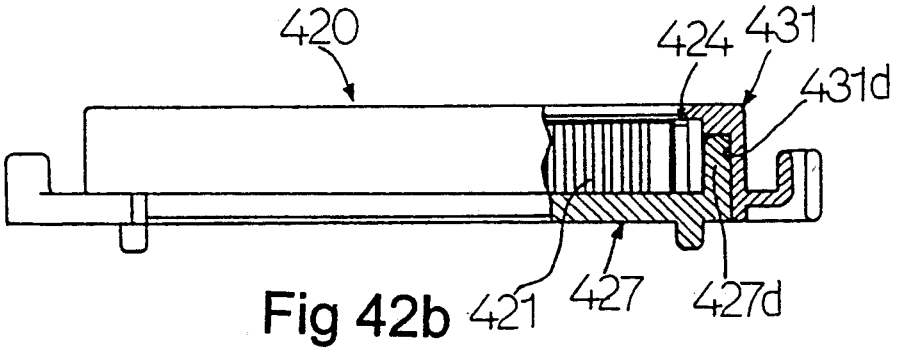
Figure 42C:
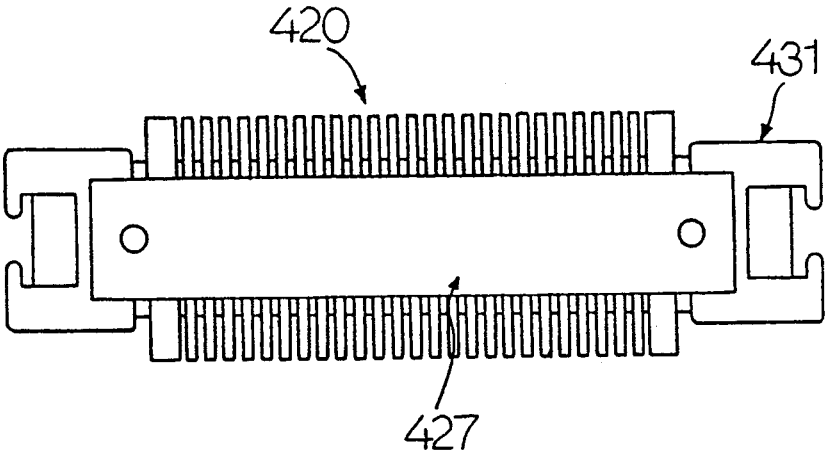

As shown particularly in FIG. 41(*a*)–(*c*), the base member 427 is rectangular in plan having a central longitudinally extending upstanding rib 427*a*, upstanding from a foot 427*b* progressively tapering to respective opposite edges thereon defining an upper film circuit clamping surface 427*c* having a contour complementary to that of the surface 424*k*.

Locating posts 427*d* upstand from opposite ends and are formed with deformable beads 427*e* extending along opposite longitudinal edges.

The receptacle is assembled by dressing the film circuit to extend down the front face of the film circuit supporting member 424 and rearwardly under the lower clamping surface 424*k*. Each film circuit supporting member is then mounted in the housing 431 by the locating projections 424*c* each being received in an interference fit in a respective groove. The base member 427 is then inserted between lower ends of the two film circuits and the locating posts 427*d* press fitted into locating grooves 431*a* with deformation of the beads 427*e* assuring the press fit. Thus, the film circuit is trapped between the complementary film circuit clamping surfaces 424*k* of the film circuit supporting member and the upper surface of the 427*c* of the foot 341*b* so that a board engaging portion 421*a* of the film circuit having free ends of conductors stripped of insulation extends from the housing below a bottom surface of the connector for resilient flexure against the circuit board, indicated in FIG. 36 by broken lines.

The individual connectors may easily be assembled, as required, and mated as shown in FIG. 36, the recesses 341*g* permitting depression of the film circuits therein by the resiling force of the elastomeric members 426 either taking out any residual slack in the film circuits or permitting a small resilient distention thereof providing engaging contact areas of the film circuits of corresponding curvative to increase the area of contact.

As the film circuits are in-molded extremely accurate positioning of the conductive paths thereon can be obtained while contact pitches can be very small enabling the connector to be of micro-miniature size.

Figure 47:
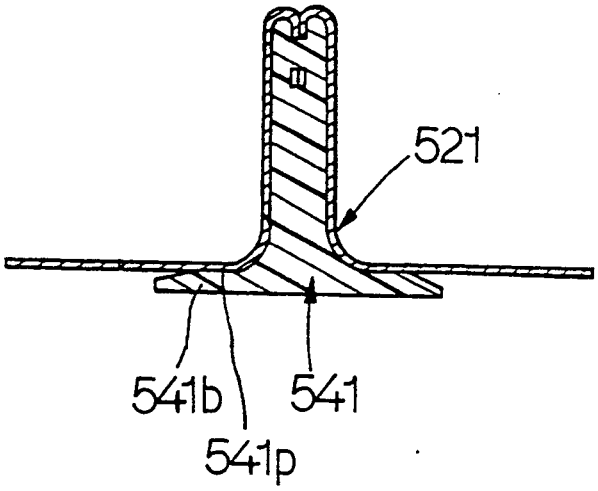
FIG. 47 is a cross-sectional view of a film circuit supporting member of the connector of FIG. 43; and, FIG. 48 is a cross-sectional view to an enlarged scale of a portion of the connector of FIG. 43 showing a film circuit pressing member aligned for insertion into the connector housing.
Figure 48:
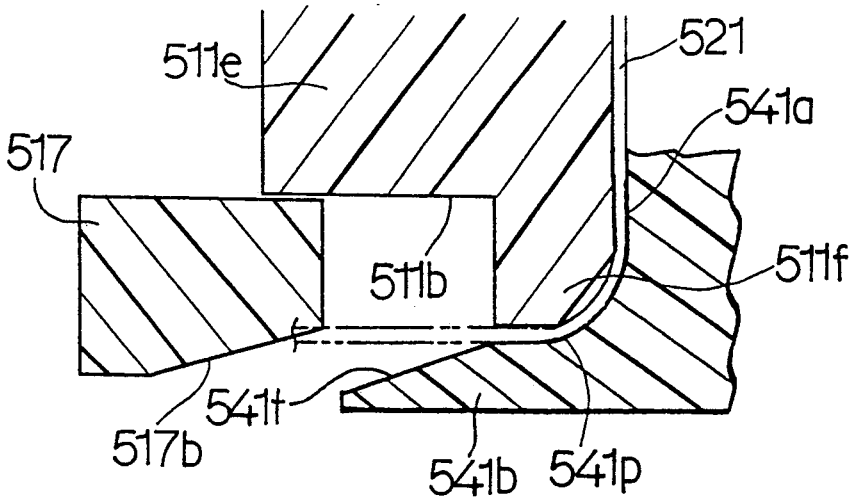

In the example of the invention shown in FIGS. 43–48, the structure of the housing 511 and the film circuit supporting member 541 of the plug connector 510 are generally similar to those of the previous example. However, as shown in FIGS. 47 and 48, portions 541*p* of upper surfaces of the foot 541*b* adjacent the film circuit supporting wall 541*a* of the film circuit supporting member 541 extend in a horizontal plane parallel to the plane of a printed circuit board 100, with the feet then tapering to the outer edge, providing surface portions 541*t* inclined downwardly towards the board so that unconstrained portions of the film circuit are supported to extend parallel to the board, as shown.

The housing 511 is modified by the provision of recesses 511*b* or channels under the bottom wall 511*e* for receipt of respective, elongate pressing members 517 having respective cable clamping surfaces 517*b* of complementary indications to surfaces 541*t* which clamp the exiting portion of the film circuit 521 initially clamped between housing wall portion 511*f* and surface 541*p* against the downwardly inclined surface portions 541*t* to extend below the connector with separated, exposed conductors 521*a* resiliently flexed into contact with the circuit board. In the example of FIGS. 43 and 44, 47 and 48 the longitudinal ends of the pressing members 517 are formed with tongues 517*c* received in slots 511*n* at longitudinal ends of the channels as interference fits thereby securing the pressing members in the recesses In the example of connector 610 shown in FIGS. 45 and 46, the foot 641*b* of the film circuit supporting member 641 is formed with a board edge receiving channel 641*p* opening away from the film circuit supporting wall and having outer wall portions 641*t* which taper inwardly as they extend away from the channel base providing film circuit supporting surfaces 641*t* inclined towards the circuit board. The pressing members 617 have film circuit clamping surfaces 617*a* of complementary shape to the film supporting surfaces 641*t* and are received in recess 611*b* defined under the base wall 611*n* between lower edges of the housing side walls 611*a* and film circuit supporting surface 641*t* and the exposed conductors 621*a* of the film, circuits pressing them against the circuit board. The pressing members 617 have complimentary catch members formed by locking ramps 617*e* received as a snap fit in locking apertures 611*d* formed in the housing side walls 611*a*, when the pressing members are moved from the position of FIG. 45 to the position of FIG. 46 the clamping surfaces 617*a* causing resilient flexure of the stripped and separated conductive tracks 621*a* of the film circuits 621 into engagement with respective conductive paths on the circuit board 101.

The last two examples also show connectors in which the conductive tracks or paths 521*b* differ in both width and pitch within the same connector providing great versatility enabling the paths to be selected according to current carrying capacity or voltage without changing the housing structure.

We claim:

1. A connector assembly for film circuitry comprising matable connector members each comprising a rigid, insulating housing assembly having a mating face and a circuit board engaging face remote from the mating face and means supporting a film circuit contact area extending in taut condition away from the mating face to the circuit board engaging face, one housing assembly having means providing a spring receiving cavity extending generally parallel to the mating face and at a location adjacent and behind the contact area of the respective film circuit, a cylindrical spring body receiving in the cavity and having an elongate face adjacent a rear face of the contact area and resiliently depressible in a mated condition of the connectors on face-to-face engagement of the respective contact areas of respective film circuits to press the contact areas into engagement thereby electrically connecting respective individual circuit tracks thereof.

2. A connector assembly according to claim 1 in which the housing assemblies comprise respective, intermatable, outer housing members having respective cavities opening to the mating face and to the circuit board engaging face and the film supporting means comprises respective elongate film circuit supporting members having upper, leading, mating ends parallel to the mating face and film circuit supporting walls extending away from the mating ends to feet, leading ends of respective film circuits being anchored in leading ends of the respective film circuit supporting members and extending along respective walls to respective feet, the spring receiving cavity being provided in at least one wall of one film circuit supporting member and, the film circuit supporting members being mounted in respective outer housing cavities by insertion into the board engaging face with the film circuit supporting wall of one film circuit supporting member extending in face-to-face adjacent relation to the film circuit supporting wall of the other member and with respective leading ends of respective film circuits adjacent respective mating faces and respective trailing circuit board engaging ends extending out of the housings at the circuit board engaging faces.

3. A connector assembly according to claim 2 in which a film circuit supporting wall of the other film circuit supporting member is recessed at a longitudinally extending location adjacent and parallel to the leading mating end aligned with the spring in the cavity of the one film circuit supporting member and behind a film circuit contact area for receipt of a portion of the film circuit contact area depressed therein by the spring in the mated condition.

4. A connector assembly according to claim 2 in which film circuit is anchored in the housing assembly by in-molding at least at a leading end.

5. A connector assembly according to claim 4 in which the film circuit supporting members include portions of increased thickness extending at spaced apart locations along ends thereof forming complementary castellations which mesh on mating, in which portions respective leading ends of respective film circuits are in-molded.

6. A connector assembly according to claim 5 in which further film circuit supporting wall portions of increased thickness, in which respective film circuits are in-molded, are formed on respective film supporting members at locations spaced from respective leading ends and in alignment with respective of the first wall portions at the respective leading ends, the respective film circuit contact areas being formed as respective strips extending longitudinally, parallel to the respective mating faces, across a front face of respective film circuit supporting walls between the first and further wall portions.

7. A connector assembly according to any claim 6 in which the spring receiving cavity is formed by a slot extending completely through the wall of one film circuit supporting member between front and rear faces providing a spring admitting mouth opening to a rear face of the wall through which the spring can be inserted into the cavity.

8. A connector assembly according to claim 2 in which at least one of the film circuit supporting members is bipartite and each part has complementary interengageable means by which the parts are assembled together in one of back-to-back and face-to-face relation defining male and female main contact bodies, respectively, with respective film circuits extending along respective opposite film circuit supporting walls thereof.

9. A connector assembly according to claim 8 in which one housing assembly includes a base member having an upper film circuit clamping surface and outer housing provides a recess adjacent and open to a board engaging face and receiving the base member with film circuit portions exiting from the housing clamped between the housing and the clamping surfaces of the base member.

10. A connector assembly according to claim 1 in which trailing end film circuit portions are constrained by the housing assembly to exit therefrom at the board engaging face inclined towards a circuit board with board engaging portions of the film circuit resiliently flexed into engagement with a circuit board on which the connector is mounted.

11. A connector assembly according to claim 2 further comprising means on respective housing assemblies to guide the connectors, with substantially zero mating force, into a partially mated condition in which the respective film circuit contact areas are in face-to-face, spaced apart relation, and actuating members mounted on one housing assembly to extend longitudinally thereof and in side-by-side relation and behind the spring, remote from the film circuit, and for forward movement towards the film circuit thereby pressing the spring against a rear face of the contact area urging the contact area of the film circuit into electrical connection with the facing film circuit contact area in a fully mated condition of the connector, and means to retain the actuating member in a forward spring pressing position.

12. A connector assembly according to claim 11 in which the retaining means comprises at least one cam member having camming surfaces progressively engageable with the actuating member during movement of the connectors into mating engagement for urging the actuating member towards the film circuit.

13. A connector assembly according to claim 12 in which the cam member comprises a pair of cam plates mounted on an outer housing at respective opposite ends of the respective film circuit supporting member and the actuating member comprises at least one cam following rod having opposite ends extending from the housing and aligned for engagement with respective cam plates.

14. A connector assembly according to claim 13 in which each cam plate has a bight opening to a leading edge and a series of inwardly stepped, arcuate camming surfaces extending away from a mouth of the bight and progressively engageable the camming rod during mating movement of the connectors together.

15. A connector according to claim 1 wherein the spring member is an helical coil spring.

16. A connector assembly according to claim 1 in which the spring member is formed by a series of individual, resilient metal loops extending in coaxial alignment from a web with which they are integrally formed.

17. A connector assembly according to claim 1 in which the spring member is a cylindrical elastomeric body.

18. A connector assembly according to claim 11 in which the film circuit supporting member of one connector is mounted in the outer housing cavity thereof for limited sliding movement relatively away from the mating face and an abutment is provided in the other connector housing assembly, engageable by the leading end of the film circuit supporting member of the one connector when the respective connectors are moved together into the partially mated condition in which respective film circuit contact areas are in face-to-face alignment, to arrest the film circuit supporting member, further mating movement being permitted by the sliding movement producing lost motion between the film circuit supporting member of the one connector and the outer housing thereof, thereby permitting movement of the outer housings to a fully mated condition in which the actuating member urges the spring member into pressure engagement with the respective film circuit thereby connecting the film circuit contact areas together.

19. A connector assembly according to claim 2 in which a film circuit has a circuit board engaging portion outside the housing and portions of at least some of the conductive tracks extending through the contact area of a film circuit inside the housing are of narrower width and pitch than portions of the same conductive tracks extending across the circuit board engaging portion.

20. A connector assembly according to claim 1 in which at least some individual conductive tracks extending through the contact area of a film circuit are of pre-selected different widths according to desired current carrying capacity.

21. A connector assembly according to claim 20 in which conductive tracks extending through the contact area of a film circuit are of pre-selected different pitches.

22. A connector assembly according to claim 4 in which a first film circuit locating member having an elongate plate-like body with a flange extending upwardly along one longitudinal edge of the body, a series of locating pegs extending outwardly from the flange; a longitudinally extending row of locating peg receiving sockets are formed in the film circuit supporting wall of a first film circuit supporting member adjacent the foot and a row of locating peg receiving apertures are formed in the respective film circuit in alignment with respective sockets, the housing having a bottom wall formed with a longitudinally extending film circuit supporting member receiving aperture, the first film circuit supporting member being mounted in the outer housing by insertion of the respective locating pegs through the respective apertures in the film circuit into respective sockets and receipt of the subassembly so formed as an interference fit in the aperture in the bottom wall of the housing.

23. A connector assembly according to claim 22 in which a second film circuit supporting member, identical to the first film circuit supporting member, and supporting a second film circuit thereon, identical to the first, is integrally formed in back-to-back relating with the first film circuit supporting member so that, together, they form a main male contact body with film circuit supporting walls on respective opposite faces thereof, a second film circuit locating member, identical to the first, securing the second film circuit, the walls of the second film circuit supporting member and the longitudinal aperture being located along a center line of the outer housing with the main contact body received within the longitudinal aperture, upstanding centrally of the outer housing recess.

24. A connector assembly according to claim 23 in which locating tongues extend from respective longitudinal ends of the feet of the main contact body and respective recesses are formed in respective longitudinal ends of the base wall of the outer housing receiving the respective tongues as force-fits therein, thereby to secure the main contact body in the outer housing.

25. A connector assembly according to claim 10 in which flanges are formed on respective opposite longitudinal ends of a film circuit supporting member and have slots aligned with the spring receiving cavity, the spring being an elastomeric member mounted in the slots in a force-fit.

26. A connector assembly according to claim 25 in which the outer housing has opposite, longitudinal ends walls formed with vertically extending, downwardly opening, film circuit supporting member locating grooves on respective opposite sides of a central longitudinal housing axis and a vertically extending, downwardly opening, base member locating groove centered on said axis, and opposite, longitudinally extending side walls having lower edges rebated above the lower edges of the end walls, the film circuit supporting members each having locating projections at respective opposite ends receivable in respective locating grooves and outwardly extending flanges engageable with the rebated lower edges of the side walls, and a base member having a longitudinal rib upstanding centrally from a foot and locating posts upstanding from respective opposite ends whereof, each film circuit supporting member being insertable through the opening in the board engaging face of the housing into the housing cavity with the locating projections received in the locating groove and the flange seated against the rebated lower edges of the side walls, and the base member being anchorable within the board engaging face by the locating posts being force-fitted in respective base member locating grooves, thereby to retain each film circuit supporting member in the housing cavity with trailing ends of the film circuit extending out of the housing below the plane of the housing base clamped between opposed surfaces of the film circuit supporting member and the base member.

27. A connector assembly according to claim 2 in which the foot of the film circuit supporting member has film circuit supporting surface portions which are inclined downwardly as they extend away from the film circuit supporting wall and the outer housing is formed with a recess under a bottom wall thereof, an elongate film circuit pressing member having a film circuit engaging surface with a complementary inclination to that of the film circuit supporting surface of the foot is receivable in the recess clamping portions of the film circuit exiting the housing between the inclined surface portions of the film circuit recessing member and the foot so that the film circuit protrudes out from the housing below the plane thereof for resilient flexural engagement with a circuit board when the housing is mounted thereon.

28. A connector assembly according to claim 27 wherein respective longitudinal ends of the housing recess and film circuit pressing members are formed with complementary mating elements engageable in a force-fit to secure the film circuit pressing members in the recess in clamping engagement with the film circuit.

29. A connector assembly according to claim 2 in which the foot of the film circuit supporting member is formed with a circuit board receiving channel extending longitudinally thereof and opening away from the film circuit supporting wall, outer wall surfaces of the channel tapering inwardly as they extend away from the film circuit supporting wall, providing film circuit supporting surfaces inclined towards a circuit board received in the channel, and elongate film circuit pressing members having film circuit engaging surfaces of complementary inclination to the film circuit supporting surfaces of the outer wall of the channel and receivable between lower edges of the longitudinal side wall of the outer housing and the outer walls of the channel to clamp portions of the film circuit exiting from the connector against the film circuit supporting surfaces of the channel wall so that the board engaging portions of the film circuits are resiliently flexed into engagement with the circuit board.

30. A connector assembly according to claim 29 in which complementary catch members are provided on the film circuit pressing members and the lower edge portion of the housing side wall, respectively, engageable in a snap action to secure the pressing member in the recess in clamping engagement with the film circuit.

31. A connector assembly according to claim 1 in which the film circuit comprises a flexible insulating web with a circuit board engaging face, a plurality of conductive tracks extending across the web remote from the board engaging face for connection to respective conductive tracks on a circuit board by a reflow solder technique, individual solder pad receiving apertures are formed through the insulating web exposing respective conductors on the web to the board engaging face so that respective individual solder pads on respective conductive tracks of the circuit board are received in the respective apertures on applying the board engaging face of the film circuit against the circuit board and remain confined substantially within the apertures effecting electrical connection between the respective individual tracks of the film circuit and circuit board during reflow solder.

32. A connector assembly according to claim 31 in which the conductive tracks extend across a face of the insulating web opposite to the board engaging face in closely spaced relation.

33. A connector assembly according to claim 1 including a film circuit fastener having a head and a shank integrally formed therewith extending through locating aperture in the film circuit and received as a force-fit in a circuit board with the head securing the film circuit in the circuit board with respective conductive tracks thereof in engagement.

34. A connector assembly according to claim 33 in which longitudinally extending beads are integrally molded on the shank, engagement of the beads with the aperture during receipt providing the force-fit.

35. A film circuit connector for mating with a complementary film circuit connector with interengagement of respective film circuits and comprising an outer housing and a film circuit supporting member;

the outer housing having a first, mating face and a second face, remote from the mating face, opposed elongate side walls and opposed end walls extending between the mating and second faces and a base wall portion extending transversely from the side walls adjacent the second housing face thereby defining a channel section cavity for receiving the mating connector, opening to the mating face, a central, elongate aperture being formed in the base wall portion in communication with the cavity;

the film circuit supporting member comprising a plastic molding having a film circuit supporting wall portion upstanding from a flanged foot having upper film clamping surfaces and a lower circuit board engaging face;

the film circuit comprising individual conductive tracks on a common surface of an insulating web and having a relatively narrow portion with mating contact areas having conductive tracks located at close pitch and relatively wide portions with conductive tracks extending in divergent manner to a series of relatively widely pitched, board connecting portions exposed from the insulating web for connection to a circuit board, the film circuit being anchored by in-molding in the top of the wall of the film circuit supporting member with portions of the mating contact areas dressed down respective opposite sides of the wall;

the film circuit supporting member being assembled with the outer housing by insertion of the wall portion through the second face and aperture of the outer housing into the cavity so that the wall portion upstands centrally of the cavity, spaced from the side walls, supporting the portions of the mating contact areas within the housing and extending away from the mating face and with the foot adjacent the second face, clamping portions of the film circuit exiting from the housing between the housing and the clamping surfaces thereof with the board engaging portions outside the housing.

36. A film circuit connector according to claim 35 in which the second face is a board engaging face and the base wall portion is spaced from the board engaging face thereby defining a housing recess opening to the board engaging face, in which recess the foot is seated when the film circuit supporting member is assembled with the outer housing.

37. A film circuit connector according to claim 35 in which at least some of the conductive tracks of the mating contact areas are of different widths and pitches.

38. A film circuit connector for mating with a complementary film circuit connector with interengagement of respective film circuits and comprising an outer housing and a film circuit supporting member;

the outer housing having a first, mating face and a second face, remote from the mating face, opposed elongate side walls and opposed end walls extending between the mating and second faces and a base wall portion extending transversely from the side walls adjacent the second housing face thereby defining a channel section cavity for receiving the mating connector, opening to the mating face, a central, elongate aperture being formed in the base wall portion in communication with the cavity;

the film circuit supporting member comprising a wall portion upstanding from a foot formed with a circuit board receiving channel extending longitudinally thereof and opening away from the wall portion thereof, the channel having outer wall surfaces, providing film circuit clamping surfaces;

a film circuit comprising individual conductive tracks on a common surface of an insulating web having mating contact areas and board connecting portions exposed from the insulating web for connection to a circuit board;

an elongate film circuit pressing member having a film circuit clamping surface;

the film circuit supporting member being assembled with the housing by insertion of the wall portion carrying the mating contact areas of the film circuit extending down sides thereof through the second face and aperture into the cavity so that the wall portion upstands centrally of the cavity spaced from the side walls with the mating contact areas of the film circuit extending away from the mating face and with the foot adjacent the second face, and with the pressing member received between the base wall portion and the foot, thereby clamping surface portions of the film circuit exiting the housing between the clamping surfaces of the pressing member and the foot so that the film circuit protrudes out from the housing for engagement of the board connecting portions with a circuit board when the connector is mounted thereon.

39. A film circuit connector according to claim 38 in which the second face is a board engaging face and the base wall portion is spaced from the board engaging face thereby defining a housing recess opening to the board engaging face, in which recess the pressing member is seated when assembled with the housing clamping portions of the film exiting the housing.

40. A connector assembly according to claim 38 wherein respective longitudinal ends of the housing recess and film circuit pressing members are formed with complementary mating elements engageable in a force-fit to secure the film circuit pressing members on the outer housing in clamping engagement with the film circuit.

41. A connector assembly according to claim 38 wherein the clamping surfaces of the foot and pressing member are of complementary downward inclination so that the film circuit exits from the housing inclined below the second face for resilient flexural engagement against the circuit board to bring exposed board connecting portions into engagement therewith.

42. A film circuit connector for mating with a complementary film circuit connector with interengagement of respective film circuits and comprising an outer housing and a film circuit supporting member;

the outer housing having a first, mating face and a second face, remote from the mating face, opposed elongate side walls and opposed end walls extending between the mating and second faces and a base wall portion extending transversely from the side walls adjacent the second housing face thereby defining a channel section cavity for receiving the mating connector, opening to the mating face, a central, elongate aperture being formed in the base wall portion in communication with the cavity;

the film circuit supporting member comprising a wall portion upstanding from a foot formed with a circuit board receiving channel extending longitudinally thereof and opening away from the wall portion thereof, the channel having outer wall surfaces, providing film circuit clamping surfaces;

a film circuit comprising individual conductive tracks on a common surface of an insulating web having mating contact areas and board connecting portions exposed from the insulating web for connection to a circuit board;

an elongate film circuit pressing member having a film circuit clamping surface;

the film circuit supporting member being assembled with the housing by insertion of the wall portion carrying the mating contact areas of the film circuit extending down sides thereof through the second face and aperture into the cavity so that the wall portion upstands centrally from the cavity spaced from the side walls with the mating contact areas of the film circuit extending away from the mating face and so that the foot is adjacent the second face and the pressing member is received between lower edges of the side wall of the outer housing and the outer wall surfaces of the channel, thereby clamping surface portions of the film circuit exiting the housing between the clamping surfaces of the pressing member and the foot, with engagement of the board connecting portions with a circuit board when the connector is mounted thereon.

43. A film circuit connector according to claim 42 in which the second face is a board engaging face and the base wall portion is spaced from the board engaging face thereby defining a housing recess opening to the board engaging face, in which recess the pressing member is seated when assembled with the housing clamping portions of the film exiting the housing.

44. A film circuit connector according to claim 42 wherein the outer wall surfaces of the channel taper as they extend away from the wall of the film circuit supporting member so that the film circuit clamping surfaces are inclined towards the circuit board and the film circuit engaging surfaces of the pressing members are of complementary inclination so that the exiting portions of the film circuits are resiliently flexed into engagement with the circuit board bringing exposed board engaging portions into engagement therewith.

45. A connector assembly according to claim 42 in which complementary catch members are provided on the film circuit pressing members and lower edge portion of the housing side wall, respectively, engageable in a snap action to secure the pressing member in the recess in clamping engagement with the film circuit.

46. An electrical connector according to claim 38 wherein the mating contact area of the film has conductive tracks of at least one of preselected different widths and pitches.

47. An electrical connector according to claim 42 wherein the mating contact areas of the film has conductive tracks of at least one of preselected different widths and pitches.

48. An electrical connector according to claim 38 in which the exposed board portions are resiliently flexed against the circuit board.

49. An electrical connector according to claim 42 in which the exposed board portions are resiliently flexed against the circuit board.

50. An electrical connector according to claim 38 in which at least some of the board engaging portions of the conductive tracks are of greater width and pitch than portions of the same conductive tracks of the mating contact area.

51. An electrical connector according to claim 42 in which portions of at least some of the board engaging portions of the conductive tracks are of greater width and pitch than portions of the same conductive tracks of the mating contact area.

52. An electrical connector according to claim 38 in which the film circuit supporting member is molded from plastic material and the film circuit is anchored on the film circuit supporting member by molding therein.

53. An electrical connector according to claim 42 in which the film circuit supporting member is molded from plastic material and the film circuit is anchored on the film circuit supporting member by molding therein.

* * * * *